US011052668B2

(12) United States Patent
Miyazawa et al.

(10) Patent No.: US 11,052,668 B2
(45) Date of Patent: Jul. 6, 2021

(54) LIQUID CONTAINER

(71) Applicant: SEIKO EPSON CORPORATION, Tokyo (JP)

(72) Inventors: Seigo Miyazawa, Shiojiri (JP); Tadahiro Mizutani, Shiojiri (JP); Taku Ishizawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/796,404

(22) Filed: Feb. 20, 2020

(65) Prior Publication Data

US 2020/0269589 A1 Aug. 27, 2020

(30) Foreign Application Priority Data

Feb. 27, 2019 (JP) ..... JP2019-034156

(51) Int. Cl.
*B41J 2/175* (2006.01)
*B41J 29/13* (2006.01)

(52) U.S. Cl.
CPC ..... *B41J 2/17523* (2013.01); *B41J 2/17506* (2013.01); *B41J 2/17509* (2013.01); *B41J 2/17513* (2013.01); *B41J 2/17553* (2013.01); *B41J 2/17596* (2013.01); *B41J 29/13* (2013.01)

(58) Field of Classification Search
CPC .... B41J 2/175; B41J 2/17506; B41J 2/17509; B41J 2/17513; B41J 2/17523; B41J 2/17553; B41J 2/17596; B41J 29/13
See application file for complete search history.

(56) References Cited

U.S. PATENT DOCUMENTS 9,855,761 B2 * 1/2018 Suzuki ..... B41J 2/175
2008/0018718 A1 * 1/2008 Ishizawa ..... B41J 2/17566 347/86
2011/0285797 A1 * 11/2011 Ogura ..... B41J 2/17513 347/86
2012/0038719 A1 * 2/2012 Shimizu ..... B41J 2/175 347/86
2018/0207939 A1 7/2018 Ishizawa et al.

FOREIGN PATENT DOCUMENTS

JP 2018-118453 A 8/2018

* cited by examiner

*Primary Examiner* — Anh T Vo
(74) *Attorney, Agent, or Firm* — Oliff PLC

(57) ABSTRACT

The liquid container includes a housing member including an external circumferential wall surrounding a liquid storing chamber, an opening surrounded by an end portion of the external circumferential wall, and a closing wall opposing the liquid storing chamber at a position deep inside with respect to the opening, an external edge portion of the closing wall coupled to an end portion of the external circumferential wall, in which the liquid outlet portion is provided in the external circumferential wall; a valve provided in the liquid outlet portion, the valve being opened by having both a first pipe through which atmospheric air flows and a second pipe through which the liquid flows inserted therein when the liquid is made to flow out from the liquid storing chamber; a flexible wall sealing the opening portion; and an inner wall that extends from the closing wall towards an opening portion side in an area surrounded by the external circumferential wall and that is in contact with the flexible wall.

7 Claims, 17 Drawing Sheets

LIQUID CONTAINER

The present application is based on, and claims priority from JP Application Serial Number 2019-034156, filed Feb. 27, 2019, the disclosure of which is hereby incorporated by reference herein in its entirety.

BACKGROUND

1. Technical Field

The present disclosure relates to a liquid container.

2. Related Art

For example, in JP-A-2018-118453 described below, an ink bottle that stores ink refilled into an ink tank of a printer is disclosed as a liquid container.

There are cases in which the contents such as atmospheric air and a liquid inside a container, not limited to an ink bottle, become expanded due to changes in the outside air temperature and the outside air pressure, and the liquid container storing the liquid becomes deformed. Such deformation may lead to deterioration such as a decrease in the durability of the liquid container and damage in the liquid container. Conversely, if the liquid container is configured so as to become flexed and deformed to allow the expansion of such contents, the strength of the liquid container itself may decrease and the liquid container may become damaged by external force applied by the user.

JP-A-2018-118453 discloses a configuration in which a restriction member is disposed inside the ink bottle to suppress deformation of the ink bottle when the ink bottle is squeezed by the user. However, in the configuration in JP-A-2018-118453, the number of parts constituting the ink bottle increases by the addition of the restriction member separate to the components of the container body.

SUMMARY

A configuration implementing the technique of the present disclosure is provided as a liquid container. The liquid container of such a configuration includes a liquid storing chamber in which a liquid is stored, and a liquid outlet portion coupled to the liquid storing chamber, in which the liquid in the liquid storing chamber is made to flow out through the liquid outlet portion when in a liquid flow out position in which the liquid outlet portion is positioned below the liquid storing chamber. The liquid container of such a configuration includes a valve provided in the liquid outlet portion, the valve being opened by having both a first pipe through which atmospheric air flows and a second pipe through which the liquid flows inserted therein when the liquid is made to flow out from the liquid storing chamber; a housing member in which the liquid storing chamber is defined therein, the housing member including an external circumferential wall that surrounds the liquid storing chamber, an opening portion surrounded by an end portion of the external circumferential wall, and a closing wall that opposes the liquid storing chamber at a position deep inside with respect to the opening portion, an external edge portion of the closing wall being coupled to an end portion of the external circumferential wall, in which the liquid outlet portion is provided in the external circumferential wall; a flexible wall having flexibility, the flexible wall sealing the opening portion; and an inner wall that extends from the closing wall towards an opening portion side in an area surrounded by the external circumferential wall and that is in contact with the flexible wall.

DESCRIPTION OF EXEMPLARY EMBODIMENTS

1. First Exemplary Embodiment

1-1. Liquid Consuming System

Figure 1:
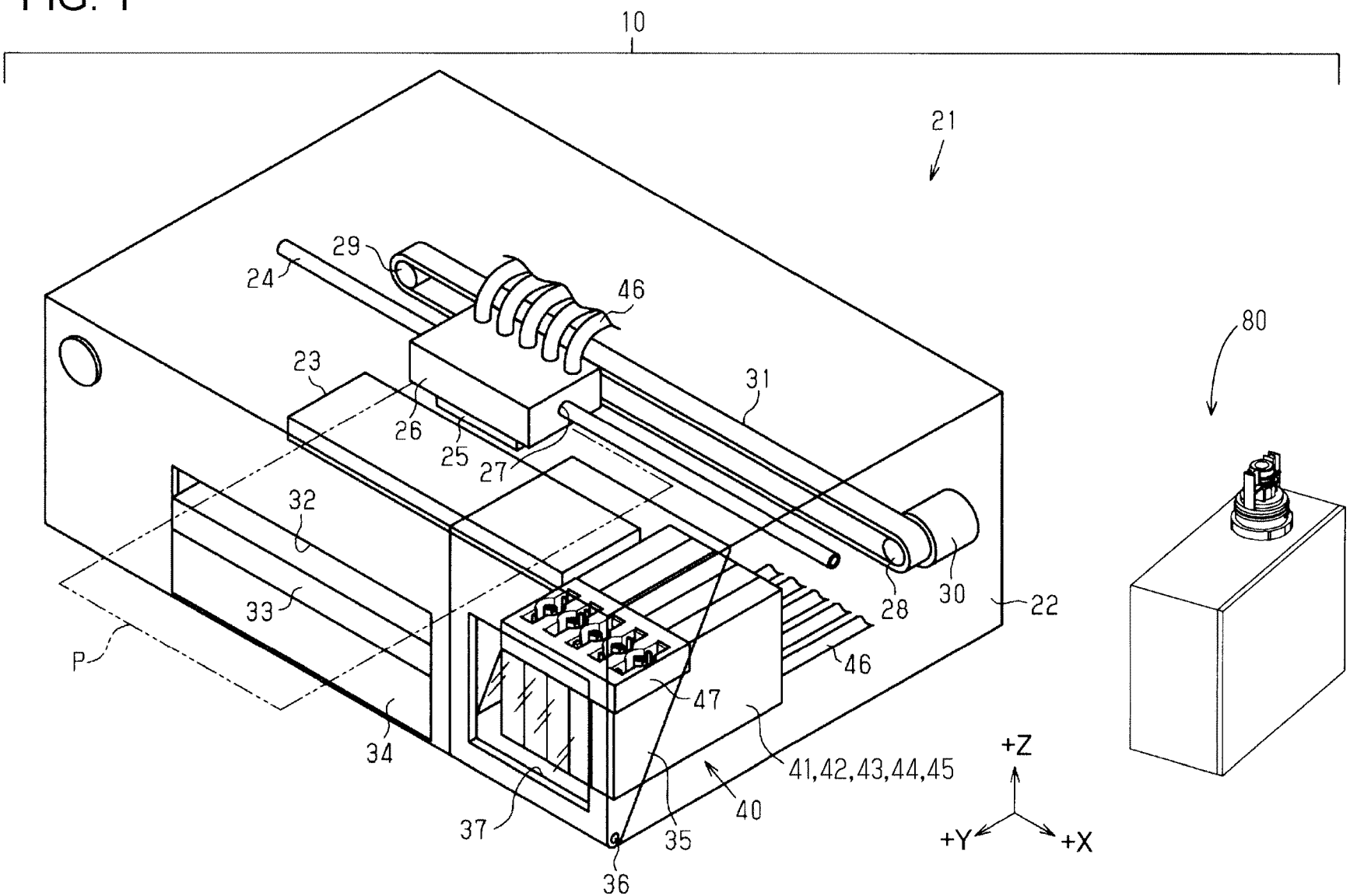
FIG. 1 is a schematic perspective view illustrating a configuration of a liquid consuming device.

FIG. 1 is a schematic view illustrating an example of a liquid consuming system 10 including a liquid container 80 according to a first exemplary embodiment. In addition to the liquid container 80, the liquid consuming system 10 includes a liquid consuming device 21 that consumes a liquid. In the liquid consuming system 10, the user refills the liquid in the liquid container 80 into the liquid consuming device 21. Hereinafter, referring first to FIGS. 1 to 5, a configuration of the liquid consuming device 21 will be described, and referring to FIGS. 6 to 10, a configuration of the liquid container 80 of the first exemplary embodiment will be described.

1-2. Liquid Consuming Device

FIG. 1 is a schematic perspective view schematically illustrating a configuration of the liquid consuming device 21. FIG. 1 illustrates the liquid consuming device 21 in a simplified manner while the components inside a housing 22 is seen through the housing 22. Furthermore, in FIG. 1, an X direction, a Y direction, and a Z direction that are orthogonal to each other are depicted so as to correspond to the liquid consuming device 21 disposed on a horizontal surface. The X direction and the Y direction are directions parallel to the horizontal direction, and the Z direction is a direction parallel to the vertical direction. The X direction matches the left-right direction of the liquid consuming device 21. In the X direction, a +X direction is the right direction when facing the front side of the liquid consuming device 21, and a −X direction is the left direction. The Y direction matches the front-rear direction of the liquid consuming device 21. In the Y direction, a +Y direction is the frontward direction, and a −Y direction is the rearward direction. The Z direction matches the up-down direction of the liquid consuming device 21. In the Z direction, a +Z direction is the upward direction and the −Z direction is the downward direction. The X direction, the Y direction, and the Z direction depicted in the drawings referred to later correspond to those in FIG. 1.

The liquid consuming device 21 is an ink jet printer that records an image and the like on a medium by ejecting ink, which is an example of the liquid, on the medium. The liquid consuming device 21 includes the housing 22 that has a rectangular parallelepiped shape in which the left-right direction is the longitudinal direction. A support base 23, in which the longitudinal direction thereof is the left-right direction, is provided in a lower rear portion inside the housing 22 so that an upper surface thereof extends in the left-right direction. A sheet of paper P, which is an example of the medium, is transported towards the front side, which is a transport direction, while the sheet of paper P is supported by the upper surface of the support base 23. A guide shaft 24 that extends in the left-right direction is provided at a position inside the housing 22 above the support base 23. A carriage 26 that includes, on an under surface side thereof, a recording head 25 that ejects ink is supported by the guide shaft 24. The guide shaft 24 is inserted through a support hole 27 that penetrates through the carriage 26 in the left-right direction. The carriage 26 is configured to reciprocate in the left-right direction relative to the guide shaft 24.

A driving pulley 28 and a driven pulley 29 are supported in a rotatable manner at positions inside the housing 22 near two ends of the guide shaft 24. An output shaft of a carriage motor 30 is coupled to the driving pulley 28. An endless timing belt 31, a portion of which is coupled to the carriage 26, is wound around the driving pulley 28 and the driven pulley 29. When printing is performed, the carriage 26 reciprocates in the left-right direction, which is a direction in which scanning is performed on the sheet of paper P, while being driven by the carriage motor 30 through the timing belt 31 and while being guided by the guide shaft 24. The ink is ejected onto the sheet of paper P, which is transported in the forward direction on the support base 23, from the recording head 25 on the under surface side of the carriage 26.

A rectangular discharge port 32 that discharges the sheet of paper P, on which recording has been performed by ejection of ink, towards the front side is formed on a front surface side of the housing 22 at a position in front of the support base 23. A rectangular plate-shaped discharge tray 33 configured to support the sheet of paper P discharged from the housing 22 is provided in the discharge port 32. The discharge tray 33 can be pulled out towards the front side. A sheet feeding cassette 34 configured to store a plurality of sheets of paper P stacked on each other is mounted inside the discharge port 32 and below the discharge tray 33. The sheet feeding cassette 34 is detectable in the front-rear direction.

In FIG. 1, the opening/closing door 35 is provided on the right end portion side in the front surface of the housing 22. A front surface and an upper surface of the opening/closing door 35 have a rectangular shape and a right surface has a right-angle triangle shape. The opening/closing door 35 is opened/closed by being pivoted in the front-rear direction about a rotation shaft 36 that is provided at a lower end of the opening/closing door 35 and that extends in the left-right direction. A window portion 37 formed of a rectangular transparent member is formed in the front surface of the opening/closing door 35. The user can view the inside of the housing 22 when the opening/closing door 35 is in a closed state. Note that the opening/closing door 35 can be provided in the front surface of the housing 22 and on either of the end portion sides of the housing 22 in the left-right direction.

An ink supplying unit 40 that supplies the ink to the recording head 25 is housed inside the housing 22 of the liquid consuming device 21 and behind the opening/closing door 35. The ink supplying unit 40 includes a plurality of ink tanks 41 to 45, or five ink tanks in the present exemplary embodiment. The ink supplying unit 40 is a structure allowing the ink tanks 41 to 45 to be managed integrally. The user refills the ink from the liquid container 80 to each of the ink tanks 41 to 45.

Figure 2:
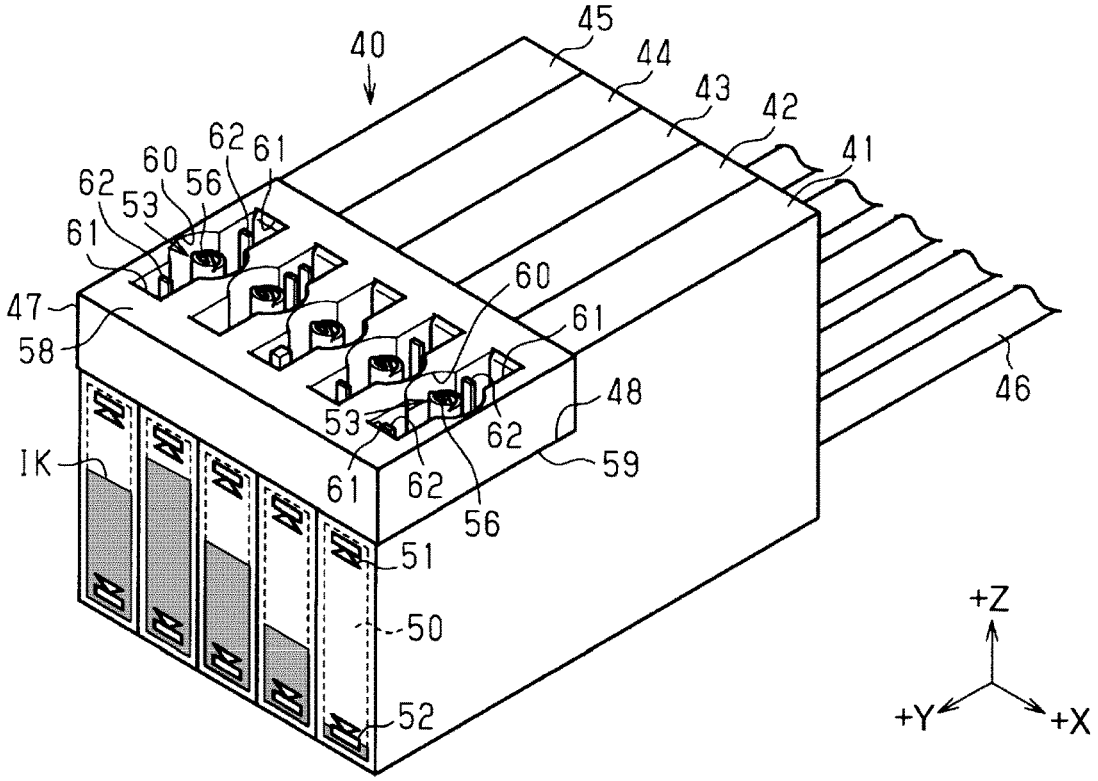
FIG. 2 is a schematic perspective view illustrating an ink supplying unit.
Figure 3:
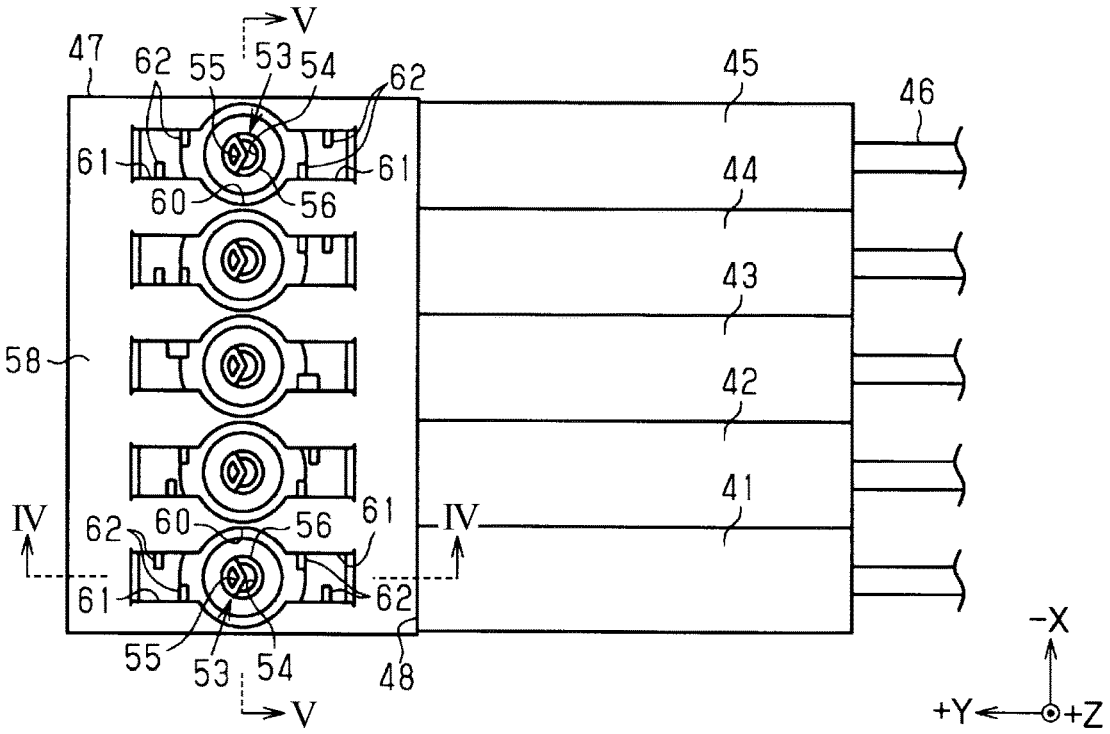
FIG. 3 is a schematic plan view illustrating the ink supplying unit.

FIG. 2 is a schematic perspective view illustrating the ink supplying unit 40. FIG. 3 is a schematic plan view illustrating the ink supplying unit 40. The ink supplying unit 40 includes, in addition to the ink tanks 41 to 45, five ink supply tubes 46 that extend out from rear surface sides of the ink tanks 41 to 45, and an adapter 47 that is mounted on the ink tanks 41 to 45 and that acts to couple the liquid container 80 to the ink tanks 41 to 45. Each of the ink tanks 41 to 45 is configured as a rectangular box in which the dimension in the left-right direction is the smallest. Each of the ink tanks 41 to 45 is coupled to the recording head 25 held in the carriage 26 illustrated in FIG. 1 through the corresponding ink supply tube 46.

Level different portions 48 to where the adapter 47 is attached are formed in the ink tanks 41 to 45. The level different portions 48 are rectangular cutaways in the upper front portions of the ink tanks 41 to 45. In the ink supplying unit 40, the ink tanks 41 to 45 are integrated and coupled to each other by having the adapter 47 having a rectangular parallelepiped shape be attached thereto while the ink tanks 41 to 45 are arranged in the left-right direction. As described later, when refilling the ink, the liquid container 80 is coupled to the adapter 47 so as to be fitted thereto.

Note that the adapter 47 may be a member constituting a portion of the housing 22 that covers the ink tanks 41 to 45 or may be integrally formed with the ink tanks 41 to 45. Furthermore, the adapter 47 does not have to include a function of being coupled to the ink tanks 41 to 45 and may be divided so that each adapter is mounted on the corresponding one of the ink tanks 41 to 45.

Figure 4:
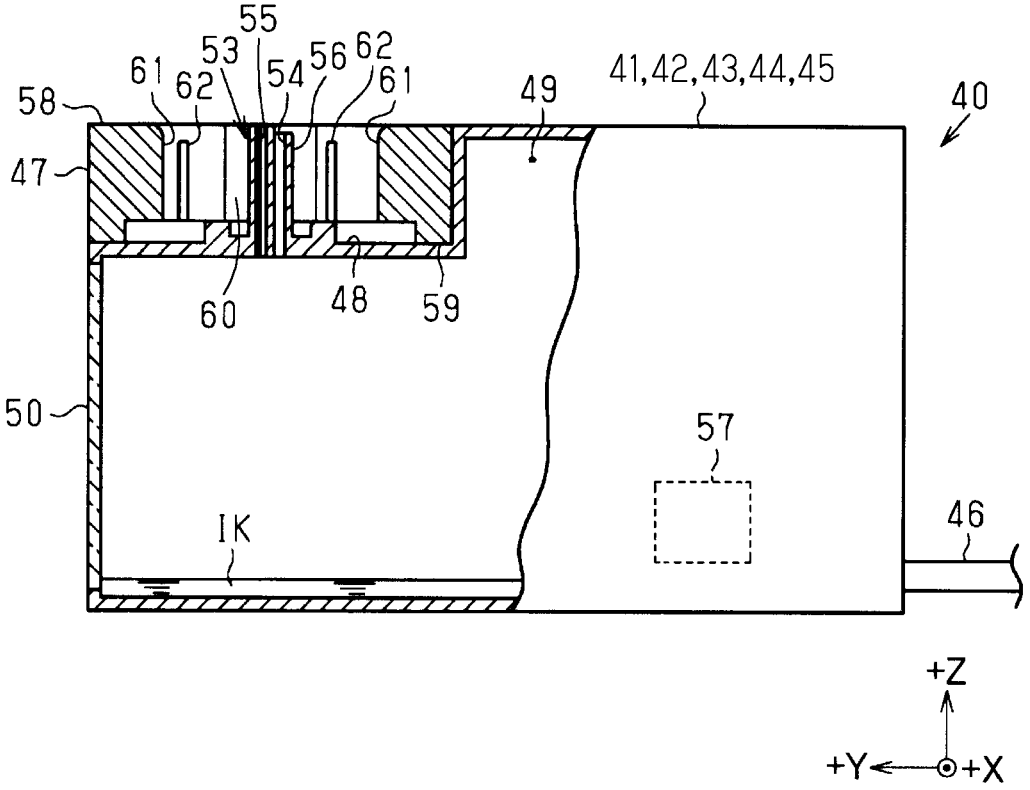
FIG. 4 is a partial and schematic cross-sectional view illustrating a lateral side of the ink tank.
Figure 5:
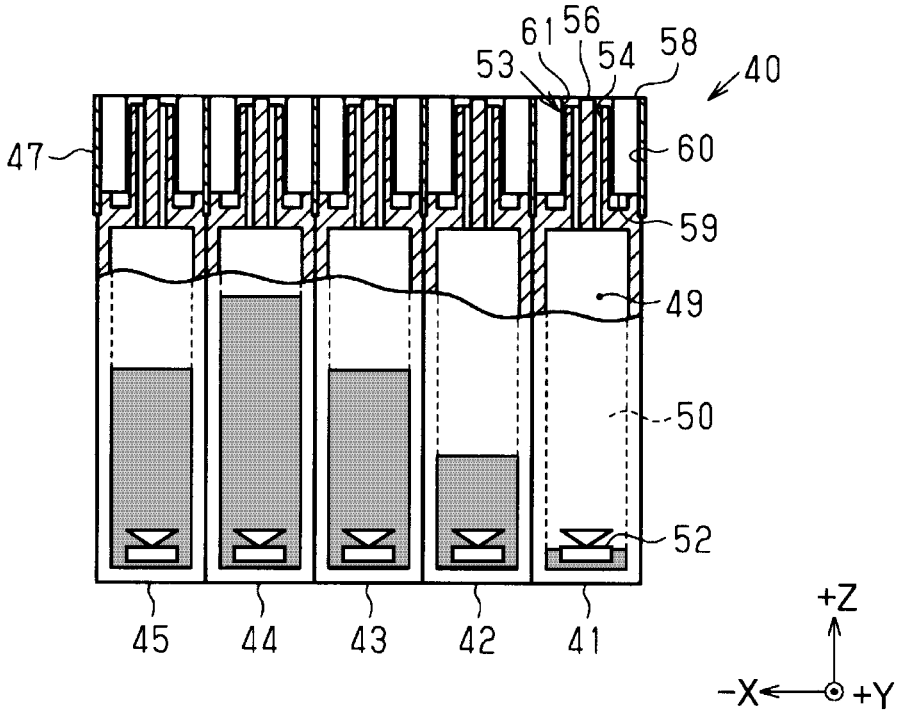
FIG. 5 is a partial and schematic cross-sectional view illustrating a front side of the ink tank.

FIGS. 4 and 5 are schematic and partial cross-sectional views that partially include cross sections of the ink tanks 41 to 45 taken along line IV-IV and V-V in FIG. 3. FIG. 4 illustrates a lateral side of the ink tanks 41 to 45, and FIG. 5 illustrates a front side of the ink tanks 41 to 45.

Each of the ink tanks 41 to 45 includes an ink storage chamber 49 configured to store ink IK therein. Ink of different colors are stored in the ink tanks 41 to 45. For example, black ink is stored in the ink tank 41 at the right end, and the ink tanks 42 to 45 arranged on the left side of the ink tank 41 store colored ink other than black such as, for example, cyan, magenta, and yellow ink.

As illustrated in FIGS. 2 and 5, tank viewing portions 50 that enable the user to view liquid surfaces of the ink IK inside the ink storage chambers 49 through the window portion 37 in the front surface of the housing 22 are provided in front walls of the ink tanks 41 to 45. The tank viewing portions 50 are configured of a transparent resin, for example. An upper limit mark 51 that indicates a reference for the upper limit of the liquid surface of the ink IK stored in the ink storage chamber 49 and a lower limit mark 52 that indicates a reference for the lower limit are marked in each tank viewing portion 50. The reference indicated by the upper limit mark 51 is, for example, a reference indicating the amount of ink that can be filled through an ink receiving portion 53 without spilling the ink. The reference indicated by the lower limit mark 52 is, for example, a reference that encourages the user to refill the ink.

As illustrated in FIG. 4, the ink receiving portion 53 that allows the ink to flow into the ink storage chamber 49 from the outside is provided on the upper side of the horizontal portion of the level different portion 48 in each of the ink tanks 41 to 45. Each ink receiving portion 53 includes a needle-like ink port 56 that extends vertically upwards. The ink port 56 is configured so that two parallel pipes 54 and 55 that communicate the inside and the outside of the ink storage chamber 49 are provided integrally. As illustrated in FIG. 3, sections of the openings of a first pipe 54 and a second pipe 55 have shapes in which a single circle is compartmented into two fan shapes with walls that extend radially from the center of the circle. The first pipe 54 is provided behind the second pipe 55 and a flow-path sectional area of the first pipe 54 is larger than that of the second pipe 55. Furthermore, as illustrated in FIG. 4, the first pipe 54 is formed so that a height of an opening at the distal end thereof is lower than a height of an opening at the distal end of the second pipe 55. A remaining amount sensor 57 that detects the amount of ink IK remaining inside the ink storage chamber 49 is provided at a rear lower portion inside each ink storage chamber 49. The remaining amount sensor 57 may be omitted.

As illustrated in FIG. 4, a through hole that penetrates the adapter 47 in the up-down direction from an upper surface 58 to an under surface 59 is formed in the adapter 47. As illustrated in FIGS. 2 and 3, the opening of the through hole has a shape in which a pair of substantially rectangular hole portions 61, the openings thereof each having a substantially rectangular section, are coupled to the front and the rear of a circular hole portion 60, the opening thereof having a substantially circular section. As illustrated in FIGS. 2 to 5, in the ink supplying unit 40, the ink port 56 of the ink receiving portion 53 included in each of the ink tanks 41 to 45 is disposed at the middle of the corresponding circular hole portion 60. As described later, when the ink is refilled into each of the ink tanks 41 to 45, a portion of a liquid outlet portion 110 of the corresponding liquid container 80 is fitted into the circular hole portion 60 and the rectangular hole portions 61. Note that colors that are the same as the colored inks stored in the ink tanks 41 to 45 may be applied as references to the rims of the circular hole portions 60 and the rims of the rectangular hole portions 61 in the upper surface 58 of the adapter 47.

In the first exemplary embodiment, discrimination protrusions 62 that protrude from the inner lateral surface of the rectangular hole portion 61 are provided inside each of the rectangular hole portions 61 of the ink tanks 41 to 45 at different positions. As described above, a fitting groove portion 116 configured to fit the discrimination protrusion 62 of one of the ink tanks 41 to 45 that stores the colored ink that matches the colored ink of the liquid container 80 is provided in the liquid outlet portion 110 of the liquid container 80. Since the discrimination protrusion 62 cannot be fitted to the fitting groove portion 116 of the liquid outlet portion 110 of the liquid container 80 that stores the colored ink that does not match the colored ink thereof, the liquid outlet portion 110 of the liquid container 80 is prevented from being fitted in the rectangular hole portions 61 of the adapter 47. Note that as illustrated in FIGS. 2 to 5, the discrimination protrusions 62 in the pair of rectangular hole portions 61 provided above each of the ink tanks 42 and 45 are provided in a point symmetrical manner with the center of the circular hole portion 60 as the point of symmetry. The reason for the above will be described later.

1-3. Configuration of Liquid Container

Figure 6:
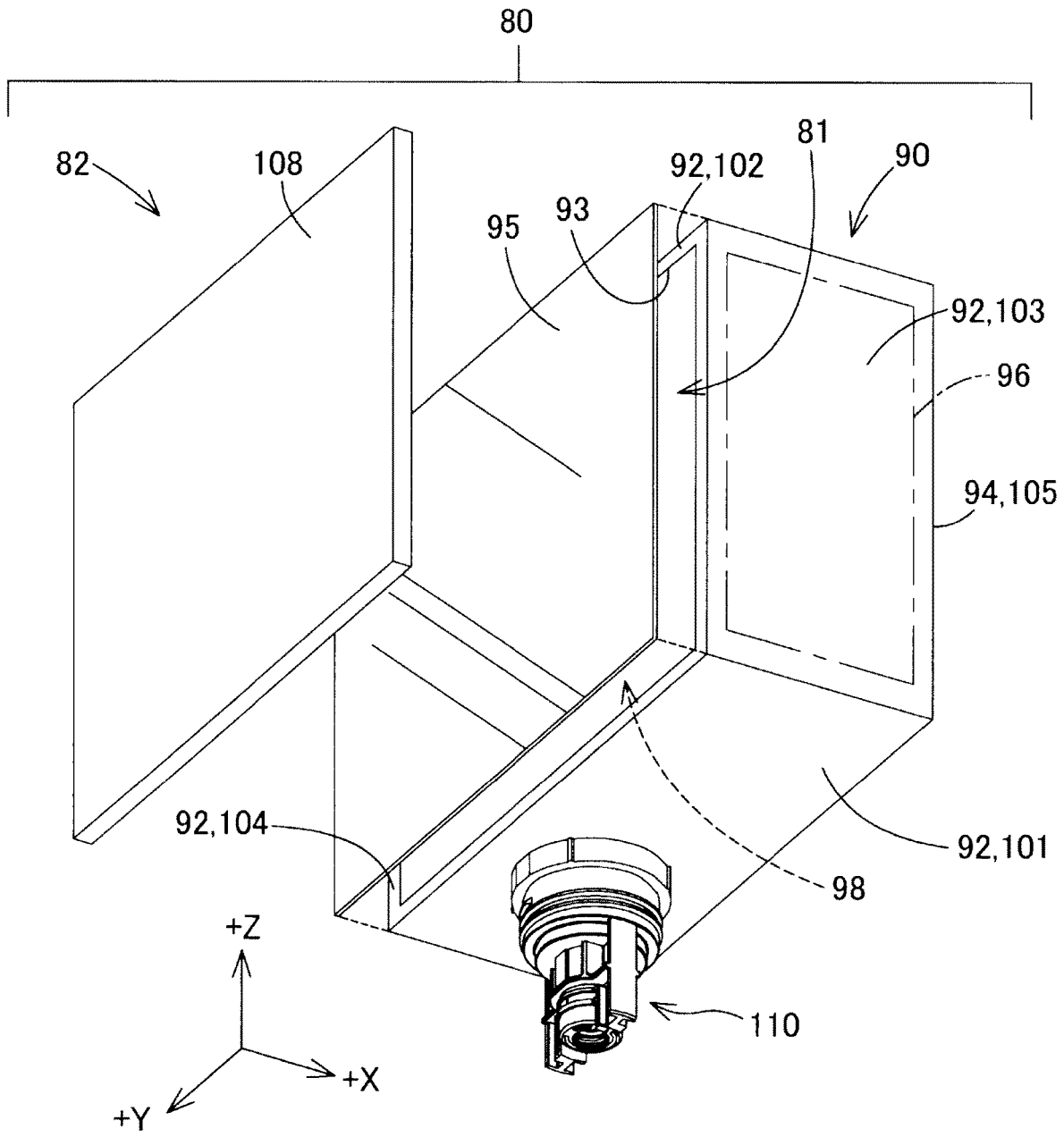
FIG. 6 is a schematic perspective view of a liquid container of a first exemplary embodiment.

FIG. 6 is a schematic exploded perspective view illustrating the liquid container 80 of the first exemplary embodiment. The liquid container 80 includes a container body 82 including a liquid storing chamber 81 that is an internal space in which the liquid is stored, and the liquid outlet portion 110 coupled to the liquid storing chamber 81. While the details will be described later, the liquid container 80 is coupled to the adapter 47, and the ink inside the liquid storing chamber 81 flows into one of the ink tanks 41 to 45 through the liquid outlet portion 110 while the liquid container 80 is positioned so that the liquid outlet portion 110 is positioned on the lower side of the liquid storing chamber. Hereinafter, the above position will be referred to as a "liquid flow out position".

Note that the X direction, the Y direction, and the Z direction illustrated in FIG. 6 are directions when the liquid container 80 is in the liquid flow out position described later in which the liquid container 80 refills the ink IK into one of the ink tanks 41 to 45 of the liquid consuming device 21. The X direction, the Y direction, and the Z direction are depicted in a similar manner in the drawings referred to later as well. Hereinafter, the X direction, the Y direction, and the Z direction in the description of the liquid container 80 denote the directions of the liquid container 80 in the liquid flow out position.

1-3-1. Configuration of Container Body

The container body 82 includes a housing member 90 in which the liquid storing chamber 81 is divided therein, a flexible wall 95 that is joined to the housing member 90, and a lid member 108 that protects the flexible wall 95. In the first exemplary embodiment, the housing member 90 is configured as a rectangular parallelepiped hollow box body having an opening in one direction. The housing member 90 is fabricated by injection molding a resin material such as, for example, polypropylene (PP) or polyethylene terephthalate (PET).

The housing member 90 includes an external circumferential wall 92 that surrounds the liquid storing chamber 81. In the first exemplary embodiment, the external circumferential wall 92 has a rectangular cylindrical shape and includes a first wall 101, a second wall 102, a third wall 103, and a fourth wall 104. Each of the walls 101 to 104 is plate shaped. A surface of each of the walls 101 to 104 may include a recessed portion or a protruded portion.

The first wall 101 opposes the second wall 102 in the Z direction with the liquid storing chamber 81 in between. In the present specification, two objects "opposing each other" includes both a state in which no other object exists between the two objects and a state in which an object is present between the two objects. In the liquid flow out position, the first wall 101 and the second wall 102 are disposed in a horizontal direction, and the first wall 101 is disposed below the second wall 102. In the present specification, "in a certain direction" is not limited to a state completely parallel to the certain direction but also includes a state of being at an angle of under 10°, for example, to the certain direction.

The liquid outlet portion 110 is provided in the first wall 101. Note that as illustrated in FIG. 7B referred to later, an outlet opening 101*h* serving as a through hole that is in communication with the liquid storing chamber 81 is provided in the first wall 101. Furthermore, a cylindrical portion 107 for attaching the liquid outlet portion 110 is provided at the periphery of the outlet opening 101*h* so as to protrude outside the housing member 90.

In the first exemplary embodiment, the liquid outlet portion 110 is provided at a position closer to the fourth wall 104 than to the third wall 103. Note that in other exemplary embodiments, the liquid outlet portion 110 can be provided at other positions. The liquid outlet portion 110 can be provided at the middle of the first wall 101 or may be provided at a position that is closer to the third wall 103 than to the fourth wall 104.

The third wall 103 is a wall that intersects the first wall 101 and the second wall 102. In the present specification, two objects "intersecting" denotes either a state in which two objects actually intersect each other, a state in which an extension portion of one of the objects intersects the other object, and a state in which extension portions of the objects intersect each other. The fourth wall 104 intersects the first wall 101 and the second wall 102, and opposes the third wall 103 in the Y direction with the liquid storing chamber 81 in between. The third wall 103 and the fourth wall 104 constitute a pair of sidewalls that oppose each other in the horizontal direction when in the liquid flow out position.

The housing member 90 further includes an opening portion 93 surrounded by end portions of the external circumferential wall 92 described above, and a closing wall 94 that opposes the liquid storing chamber 81 at a position deep inside with respect to the opening portion 93. The closing wall 94 intersects the four walls 101 to 104 constituting the external circumferential wall 92. The external edge portion of the closing wall 94 is coupled to an end portion of the external circumferential wall 92. The closing wall 94 is a fifth wall 105 that constitutes the housing member 90.

The flexible wall 95 is configured of a flexible film member. The flexible wall 95 is joined to an end surface of the external circumferential wall 92 by, for example, welding so as to seal the opening portion 93 of the housing member 90. The flexible wall 95 opposes the fifth wall 105 of the housing member 90 in the X direction. In the container body 82, the flexible wall 95 constitutes a wall that is, compared with the walls 104 to 105 that constitute the housing member 90, less rigid and easier to become flexed and deformed. The flexible wall 95 is formed of resin such as, for example, polypropylene or polyethylene terephthalate.

When the ink stored in the liquid storing chamber 81 becomes expanded due to changes in the outside air temperature and the outside air pressure, the liquid container 80 allows the ink to expand by having the flexible wall 95 become flexed and deformed. Accordingly, the load that the walls 101 to 105, which constitute the housing member 90 having high strength, receive is reduced and the durability of the liquid container 80 to the changes in the outside air temperature and outside air pressure can be increased.

The lid member 108 is configured of a plate-shaped member that has a rigidness that is higher than that of the flexible wall 95. The lid member 108 is formed of resin such as, for example, polypropylene or polyethylene terephthalate. The lid member 108 is disposed so as to overlap the flexible wall 95 and cover the flexible wall 95. An external circumferential edge portion of the lid member 108 is fixed to the external circumferential wall 92 of the housing member 90. However, a gap is formed between the lid member 108 and the flexible wall 95 so that the flexing and deforming of the flexible wall 95 described above are not inhibited. The lid member 108 may be omitted.

Note that FIG. 1 illustrates as an example a state in which the liquid container 80 is disposed on a horizontal surface with the second wall 102 as the bottom wall. In the first exemplary embodiment, the liquid container 80 is configured so that a stable position can be maintained even when either one of the second wall 102, the third wall 103, and the fourth wall 104, serving as a bottom wall, is disposed in a horizontal direction and on a horizontal surface. When a liquid is stored in the liquid storing chamber 81 and when either one of the walls 102, 103, and 104 is disposed as a bottom wall on a horizontal surface, the liquid container 80 is configured so that the center of gravity thereof is located on the bottom wall side and is located at a position closer to the center of the liquid container 80 in the horizontal direction. With the above, the liquid container 80 can easily be made to stand in a stable manner when the liquid container 80 is not used.

Furthermore, in the first exemplary embodiment, among the walls 103 and 104 that constitute a pair of sidewalls, a viewing portion 96 formed of transparent resin is provided in the third wall 103. When the liquid container 80 is in the fluid flow out position or in a position in which the second wall 102 serving as the bottom wall is disposed on a horizontal surface, the user can visually confirm the position of the liquid surface of the ink stored in the liquid storing chamber 81 from the side of the housing member 90 through the viewing portion 96. As in the tank viewing portion 50 of each ink tanks 41 to 45, a mark that indicates the position of the liquid surface of the ink IK may be provided in the viewing portion 96. Furthermore, the viewing portion 96 does not have to be configured of a completely transparent resin and may be configured of a translucent resin.

Figure 9:
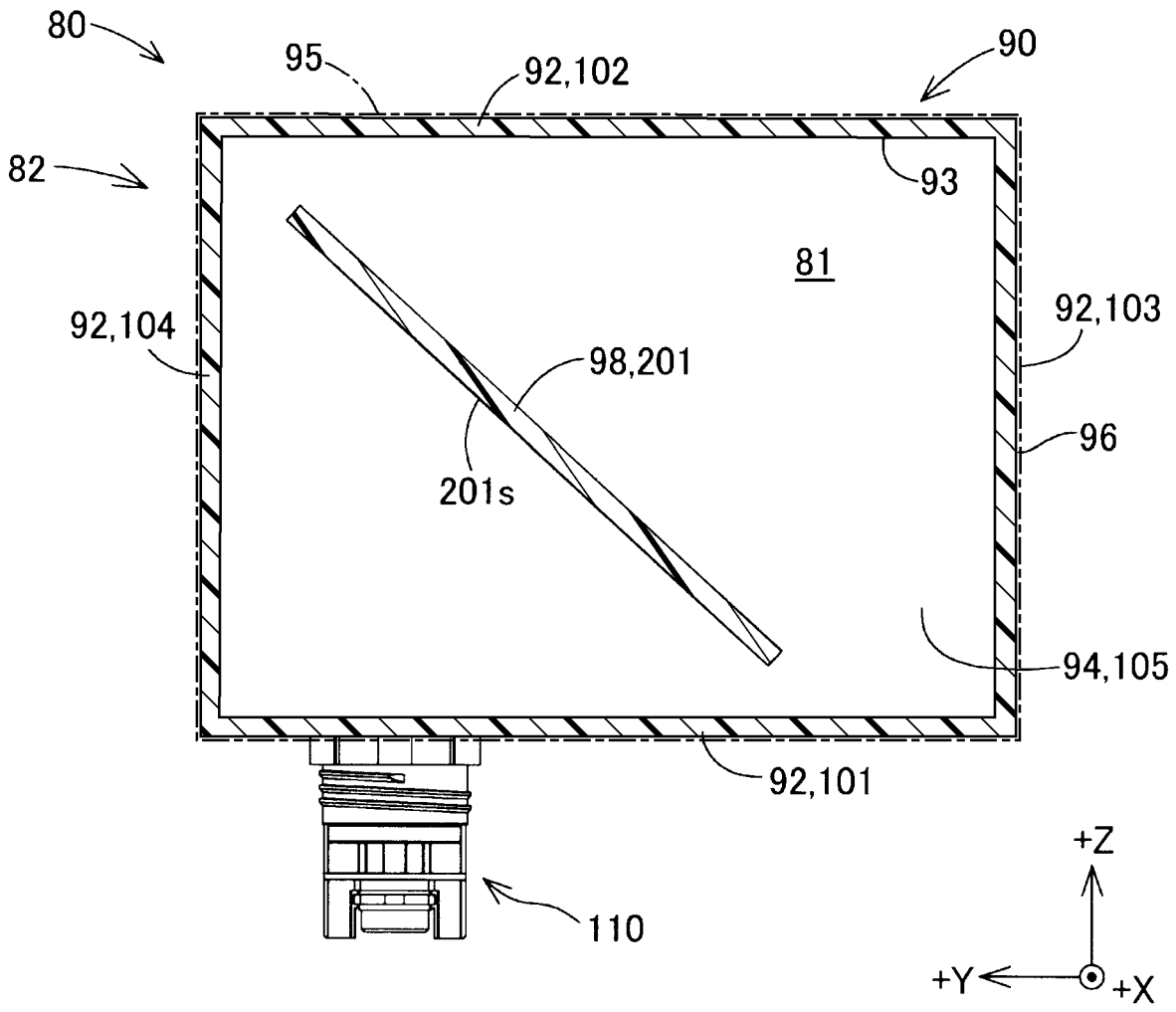
FIG. 9 is a schematic side view illustrating the liquid container of the first exemplary embodiment.

Incidentally, while the flexible wall 95 is hidden and cannot be seen in FIG. 6, as illustrated in FIG. 9 referred to later, an inner wall 98 is provided inside an area surrounded by the external circumferential wall 92 of the housing member 90. A configuration and a function of the inner wall 98 will be described after describing a configuration of the liquid outlet portion 110 and refilling of the ink into the ink tanks 41 to 45 through the liquid outlet portion 110.

1-3-2. Liquid Outlet Portion

Figure 7A:
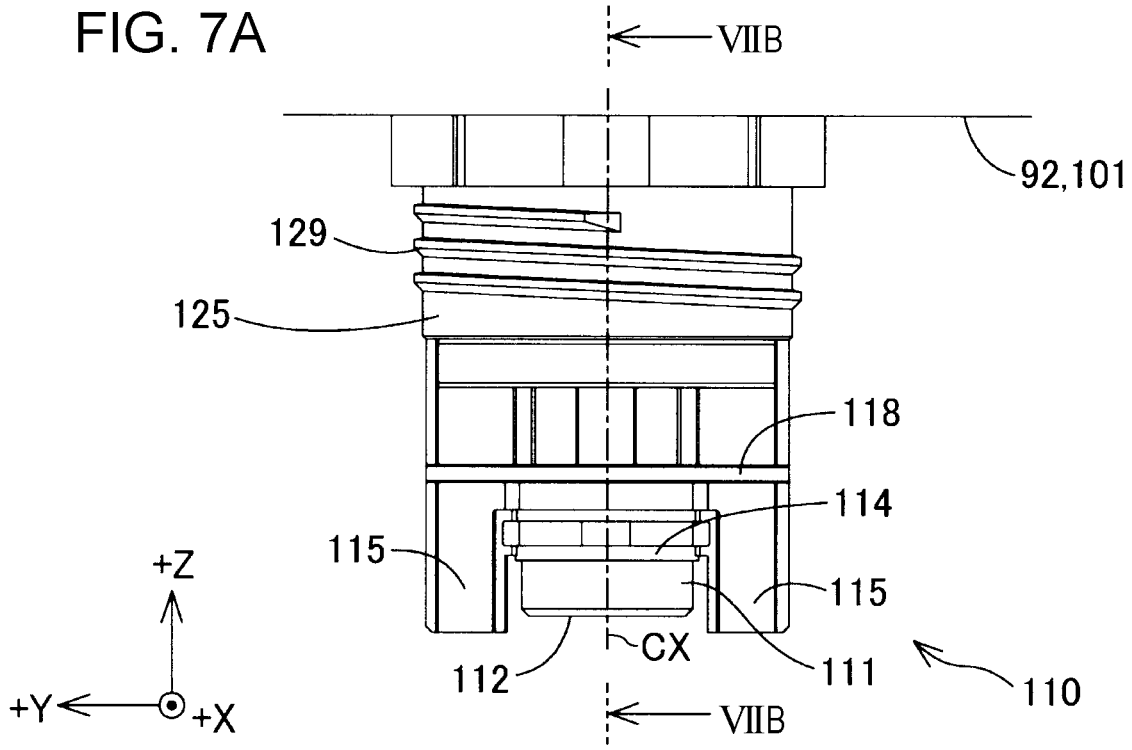
FIG. 7A is a schematic side view of a liquid outlet portion.
Figure 7B:
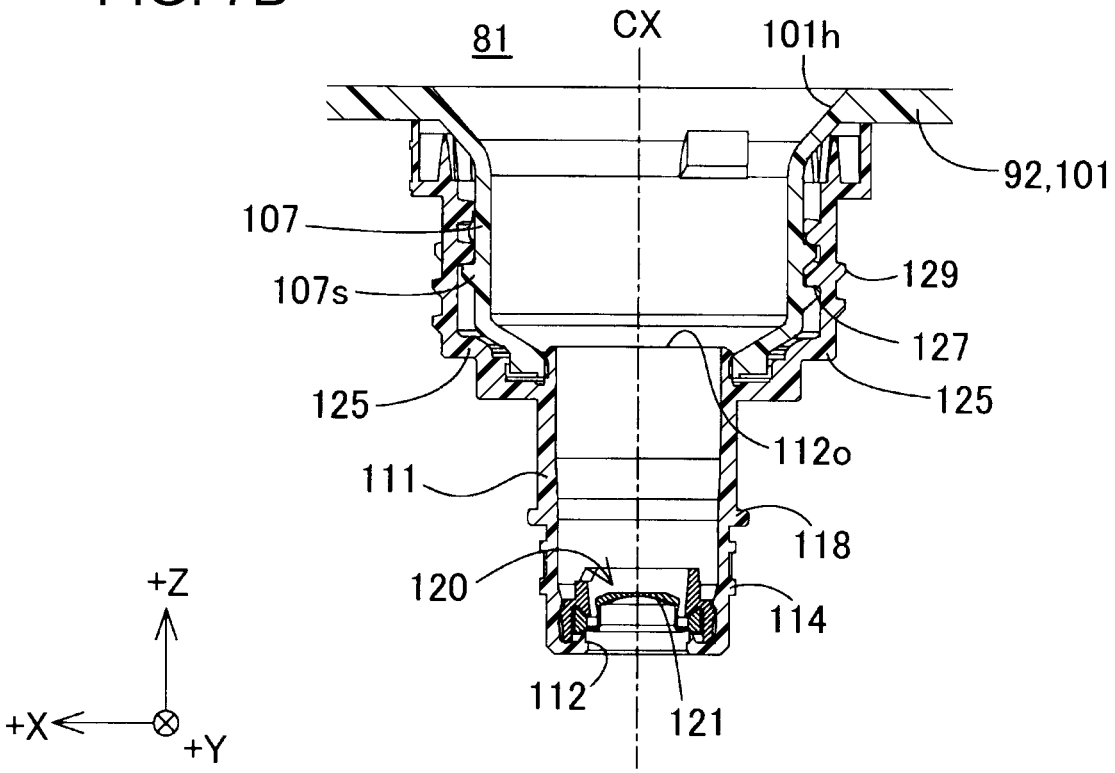
FIG. 7B is a schematic cross-sectional view of the liquid outlet portion.
Figure 7C:
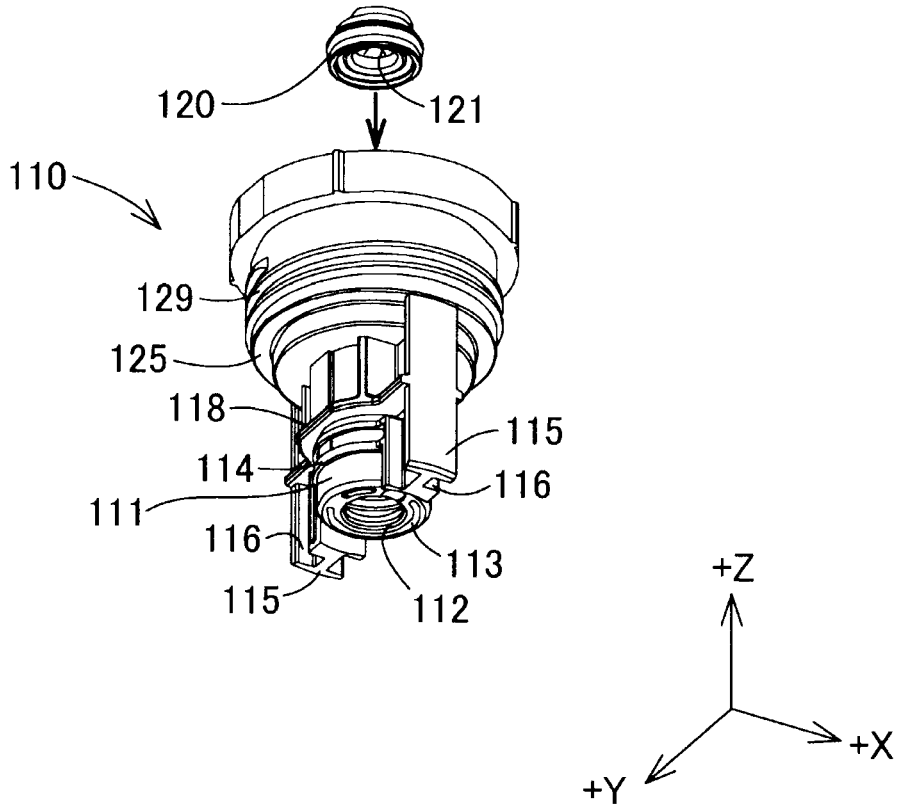
FIG. 7C is a schematic and exploded perspective view illustrating a state in which a valve member has been taken out from the liquid outlet portion.

FIG. 7A is a schematic side view of the liquid outlet portion 110 viewed in the −X direction. FIG. 7B is a schematic cross-sectional view of the liquid outlet portion 110 cut along VIIB-VIIB in FIG. 7A. FIG. 7C is a schematic and exploded perspective view illustrating a state in which a valve 120 has been removed from the liquid outlet portion 110.

The liquid outlet portion 110 is, as described above, provided in the external circumferential wall 92 of the housing member 90 and functions as a so-called spout. In the first exemplary embodiment, the liquid outlet portion 110 is configured of a cylindrical member that is attached to the housing member 90 later and includes a coupling opening 112 at an end portion thereof on the −Z direction side. Hereinafter, a side of the liquid outlet portion 110 on which the coupling opening 112 is provided is referred to as a "front end side", and a side opposite to the front end side is referred to as a "rear end side". The liquid outlet portion 110 is fabricated by injection molding a resin material such as, for example, polypropylene or polyethylene terephthalate.

As illustrated in FIGS. 7A to 7C, the liquid outlet portion 110 includes a tubular pipe portion 111. As illustrated in FIG. 7B, the pipe portion 111 includes the coupling opening 112 on the front end side and, on the rear end side, a rear end opening 112*o* that is in communication with the liquid storing chamber 81. In the first exemplary embodiment, the pipe portion 111 has a cylindrical shape. The pipe portion 111 has a diameter that fits into the circular hole portion 60 of the adapter 47 illustrated in FIG. 3. As illustrated later, the coupling opening 112 of the pipe portion 111 allows the pipes 54 and 55 constituting the ink port 56 to be inserted therein. The coupling opening 112 can be understood as an exit through which the ink flows out.

As illustrated in FIG. 7C, a groove portion 113 is formed in an end surface of the pipe portion 111 on the front end side and along an external circumference of the coupling opening 112. By providing the groove portion 113, the ink adhered to the periphery of the coupling opening 112 after refilling the ink into one of the ink tanks 41 to 45 can be made to flow into the groove portion 113 and be stored before the ink drips to the lateral surface of the pipe portion 111. Accordingly, dripping of the ink adhered to the periphery of the coupling opening 112 to the lateral surface of the pipe portion 111 can be suppressed.

As illustrated in FIGS. 7A to 7C, an annular protrusion 114 that protrudes in a radial direction that is orthogonal to a central axis CX of the pipe portion 111 and that is formed along an external circumference of the pipe portion 111 is provided on a lateral surface of the external circumference of the pipe portion 111. The annular protrusion 114 can stop the liquid that has spilt from the coupling opening 112 to the lateral surface of the pipe portion 111 from moving along the lateral surface of the pipe portion 111 and dripping to the rear end side. Note that in the present specification, the "radial direction" of the tubular or cylindrical member indicates a direction orthogonal to the central axis of the tubular or cylindrical member.

Referring to FIGS. 7A and 7C, the liquid outlet portion 110 further includes a pair of fitting portions 115 on two sides of the pipe portion 111 in the radial direction. Each of the pair of fitting portions 115 is configured to fit into the corresponding rectangular hole portion 61 of the adapter 47 illustrated in FIGS. 2 to 4. In the first exemplary embodiment, the fitting portions 115 are formed as rectangular columnar members extending along the pipe portion 111. As illustrated in FIG. 7C, the fitting groove portions 116 are provided along the pipe portion 111 and in lateral surfaces of the fitting portions 115. The fitting groove portions 116 are configured so that the discrimination protrusions 62 provided in the rectangular hole portions 61 illustrated in FIGS. 2 to 4 fit therein. Note that the pair of fitting portions 115 may be omitted.

As illustrated in FIGS. 7A to 7C, the liquid outlet portion 110 further includes a positioning portion 118 that extends out in the radial direction in the lateral surfaces of the pipe portion 111 and the fitting portions 115. The positioning portion 118 includes an upper surface that faces the front end side and that extends in the radial direction. As described later, when the liquid container 80 is coupled to the adapter 47, the upper surface of the positioning portion 118 abuts against the upper surface 58 of the adapter 47 at the peripheries of the circular hole portion 60 and the rectangular hole portions 61. With the above, the position of the liquid container 80 is set when the ink is refilled into one of the ink tanks 41 to 45.

Referring to FIGS. 7B and 7C, the valve 120 is a member that seals the coupling opening 112 of the liquid outlet portion 110 in an openable/closable manner. The valve 120 in the first exemplary embodiment is configured as a so-called slit valve. A body of the valve 120 is configured of an elastic member such as a silicon film, and a slit 121 that is opened/closed by being deformed in a thickness direction is provided at the middle. As illustrated by an arrow in FIG. 7C, the valve 120 is inserted inside the liquid outlet portion 110 from the rear end side and, as illustrated in FIG. 7B, is attached to the front end of the pipe portion 111 so as to seal the coupling opening 112. The valve 120 is fixed on the front end side with respect to the positioning portion 118. As described later, when the ink is made to flow out from the liquid storing chamber 81, the valve 120 is opened by having the first pipe 54 though which atmospheric air flows and a second pipe 55 through which the ink flows push open and be inserted into the slit 121.

As illustrated in FIGS. 7A to 7C, the liquid outlet portion 110 includes, on a rear end side with respect to the positioning portion 118, a mounting portion 125 to fix the liquid outlet portion 110 to the external circumferential wall 92. The mounting portion 125 is configured as a cylindrical member having a diameter that is larger than that of the pipe portion 111. As illustrated in FIG. 7B, a female screw portion 127 that is screwed together with a male screw portion 107*s* provided in an external circumference of the cylindrical portion 107 provided in the first wall 101 is provided in an internal circumferential surface of the mounting portion 125.

Note that while illustration thereof and a detailed description thereof will be omitted, a cap that covers and protects the distal end portion of the liquid outlet portion 110 is provided in a detachable manner in the liquid outlet portion 110. A male screw portion 129 to fix the cap is provided in an external circumferential surface of the mounting portion 125.

1-3-3. Refilling Ink into Ink Tank

Figure 8A:
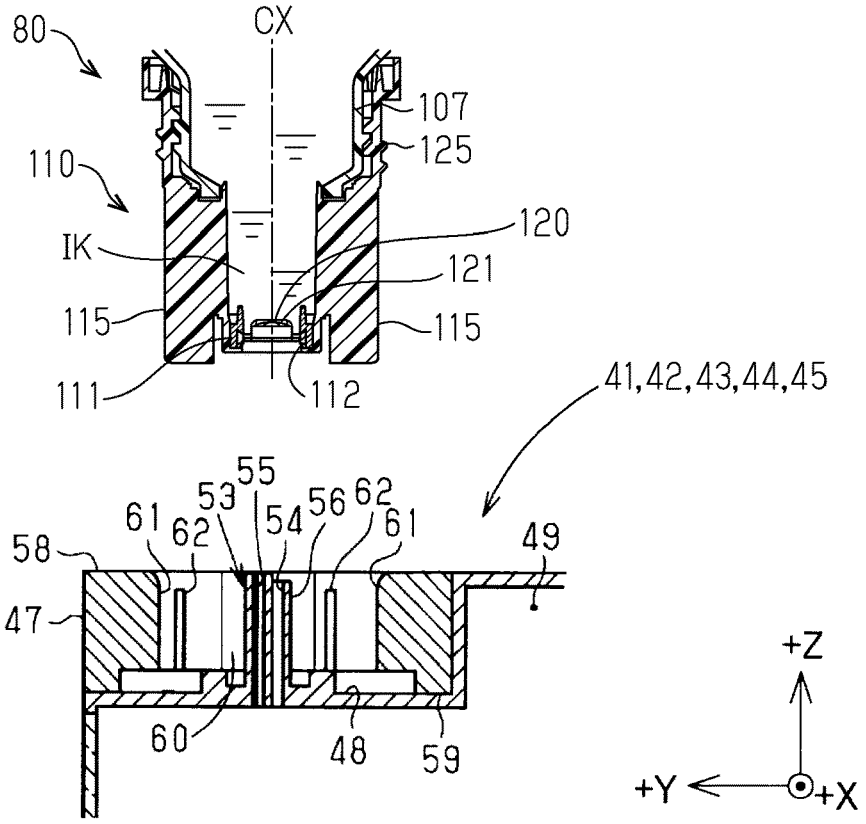
FIG. 8A is a first explanatory drawing illustrating a process of coupling the liquid outlet portion to the ink tank.
Figure 8B:
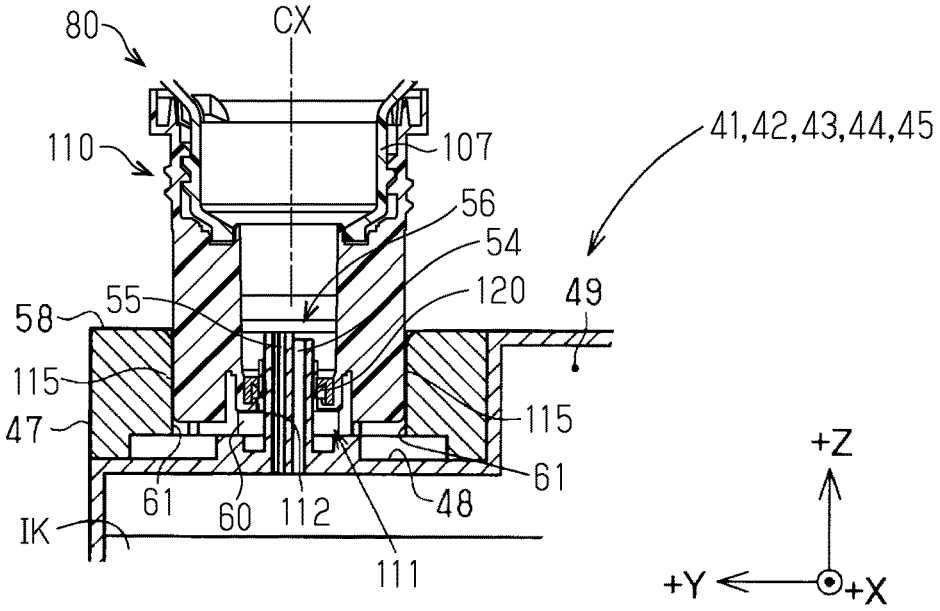
FIG. 8B is a second explanatory drawing illustrating the process of coupling the liquid outlet portion to the ink tank.

Referring to FIGS. 8A and 8B, a process of refilling the ink into one of the ink tanks 41 to 45 from the liquid container 80 will be described. FIGS. 8A and 8B are schematic cross-sectional views illustrating a process of coupling the liquid outlet portion 110 to one of the ink tanks 41 to 45. FIG. 8A schematically illustrates a state before the liquid outlet portion 110 of the liquid container 80 is coupled to the adapter 47 attached to the ink tanks 41 to 45. FIG. 8B schematically illustrates a state after the liquid outlet portion 110 has been coupled to the adapter 47. The refilling of the ink into one of the ink tanks 41 to 45 is performed, for example, when the user confirms that the liquid surface of the ink IK is at the lower limit mark 52 or lower through the tank viewing portion 50.

Referring to FIG. 8A, first, the liquid container 80 is set to the liquid flow out position by positioning the liquid outlet portion 110 below the liquid storing chamber 81. In the first exemplary embodiment, the liquid flow out position is a position in which the central axis CX of the coupling opening 112 of the liquid outlet portion 110 coincides with the gravitational direction. Subsequently, the liquid container 80 is set so that the pair of fitting portions 115 of the liquid outlet portion 110 are arranged in the front-rear direction of the ink tanks 41 to 45. Note that before the liquid container 80 is coupled to the adapter 47, since the valve 120 is in a valve closed state in which the slit 121 of the valve 120 is closed, even when the front end of the liquid container 80 is oriented in the gravitational direction, the ink is suppressed from flowing out from the coupling opening 112 by the valve 120.

Subsequently, the coupling opening 112 of the liquid container 80 is positioned above the ink port 56 of one of the ink tanks 41 to 45 and the liquid container 80 is moved downwards. With the above, as illustrated in FIG. 8B, the pipe portion 111 of the liquid outlet portion 110 fits into the circular hole portion 60 of the adapter 47 and the fitting portions 115 of the liquid outlet portion 110 are fitted into the corresponding rectangular hole portions 61 of the adapter 47. Note that in so doing, when the liquid container 80 is about to be coupled to one of the ink tanks 41 to 45 containing colored ink that does not match that of the liquid container 80, the discrimination protrusions 62 provided in the rectangular hole portions 61 cannot be fitted into the fitting groove portions 116 provided in the fitting portions 115. Accordingly, the liquid container 80 can be prevented from being erroneously coupled to one of the ink tanks 41 to 45 that contains the colored ink that does not match that of the liquid container 80.

Note that as described above, the ink supplying unit 40 includes pairs of rectangular hole portions 61 in which each pair includes the discrimination protrusions 62 provided in a point symmetrical manner with the center of the circular hole portion 60 as the point of symmetry. By configuring each pair of rectangular hole portions 61 in the above manner, the discrimination protrusions 62 can be fitted into the fitting groove portions 116 of the fitting portions 115 regardless of which of the pair of fitting portions 115 of the matching liquid outlet portion 110 is oriented towards the front side. Accordingly, regardless of the orientation of the pair of fitting portions 115 in the front-rear direction, the liquid container 80 containing the matching ink can be coupled and, accordingly, user-friendliness is increased.

When the liquid outlet portion 110 is fitted into the circular hole portion 60 and the rectangular hole portions 61 of the adapter 47, the ink port 56 at the middle of the circular hole portion 60 is inserted through the slit 121 of the valve 120 and into the coupling opening 112 in the +Z direction. In so doing, since the height of the front end opening of the second pipe 55 is higher than the height of the front end opening of the first pipe 54 in the ink port 56, the second pipe 55 is inserted first into the coupling opening 112 and the ink in the liquid storing chamber 81 flows into the second pipe 55. Subsequently, when the front end opening of the first pipe 54 is inserted into the coupling opening 112, the atmospheric air inside the ink storage chamber 49 of the relevant one of the ink tanks 41 to 45 flows into the liquid storing chamber 81 through the first pipe 54. As described above, the second pipe 55 of the ink port 56 functions as a liquid flow path, and the first pipe 54 functions as an atmospheric air flow path. Accordingly, after the above, even when the user does not perform any operation such as squeezing of the liquid container 80, the ink inside the liquid container 80 and the atmospheric air inside the ink storage chamber 49 are exchanged and the ink is refilled into the ink storage chamber 49.

Note that when the ink port 56 is inserted into the coupling opening 112 with the liquid outlet portion 110 in a tilted position, and the front end opening of the first pipe 54 is inserted inside the coupling opening 112 before the front end opening of the second pipe 55, the ink flows into the first pipe 54 and the atmospheric air flows into the second pipe 55. Accordingly, in the liquid container 80, the second pipe 55 may function as the atmospheric air flow path and the first pipe 54 may function as the liquid flow path.

1-3-4. Inner Wall

FIG. 9 is a schematic side view of the liquid container 80 viewed in the −X direction. In FIG. 9, the liquid container 80 is illustrated in the fluid flow out position. Furthermore, in FIG. 9, for convenience sake, the area where the flexible wall 95 is disposed is depicted by a dot and dash line and illustration of the lid member 108 has been omitted.

The housing member 90 includes the inner wall 98 in an area surrounded by the external circumferential wall 92. The inner wall 98 extends from the closing wall 94 towards the opening portion 93 and is in contact with a surface of the flexible wall 95 on the liquid storing chamber 81 side. When the housing member 90 is fabricated by injection molding, the inner wall 98 is integrally fabricated together with the external circumferential wall 92 and the closing wall 94. In the first exemplary embodiment, an end surface of the inner wall 98 on the +X direction side is not joined to the flexible wall 95.

In the liquid container 80, since the flexible wall 95 is supported by the inner wall 98 from the liquid storing chamber 81 side, even when external force in the −X direction is applied to the container body 82, the liquid container 80 can be suppressed from becoming damaged caused by excessive flexing and deformation of the flexible wall 95 in the −X direction. Furthermore, since the inner wall 98 functions as a reinforcing rib, the strength of the closing wall 94 against external force in the X direction, which is the thickness direction, can be increased.

Note that in the first exemplary embodiment, the inner wall 98 is formed in the Y direction from a position close to the third wall 103 to a position close to the fourth wall 104. Furthermore, the inner wall 98 is formed in the Z direction from a position close to the first wall 101 to a position close to the second wall 102. With the above, the supporting property of the inner wall 98 supporting the flexible wall 95 is improved further. Furthermore, the strength of the closing wall 94 is increased further.

As described above, in the first exemplary embodiment, the inner wall 98 and the flexible wall 95 are not joined to each other. Accordingly, when the outside air temperature and the outside air pressure change and the content in the liquid storing chamber 81 becomes expanded, the flexible wall 95 can be flexed and deformed in the +X direction without being inhibited by the joint with the inner wall 98. Accordingly, the load that the housing member 90 receives due to the expansion of the content of the liquid storing chamber 81 is reduced furthermore.

Figure 10:
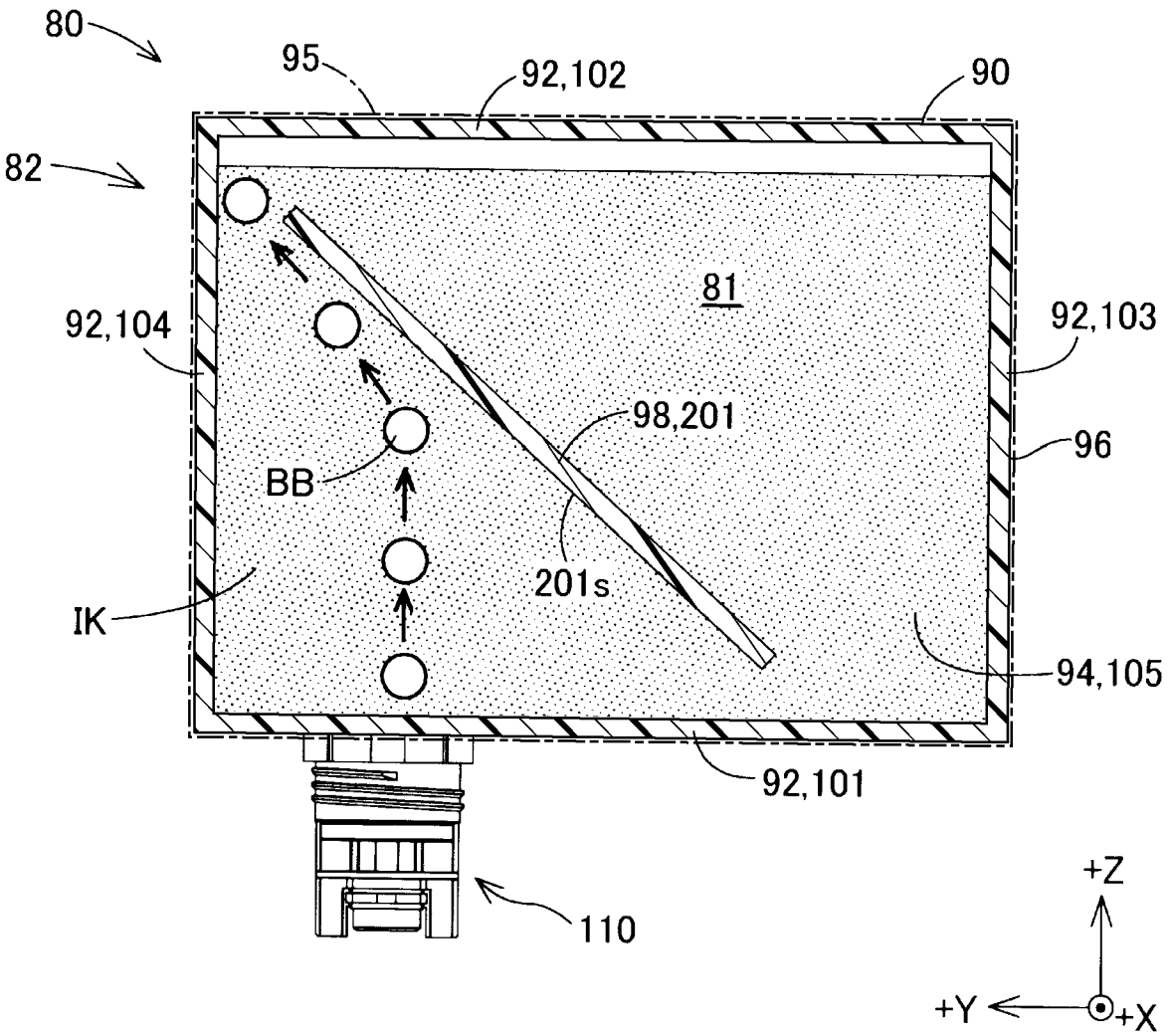
FIG. 10 is a schematic side view schematically illustrating a state inside the liquid container when ink flows out through the liquid outlet portion.

FIG. 10 is a schematic side view schematically illustrating a state inside the liquid container 80 when the ink IK in the liquid storing chamber 81 flows out through the liquid outlet portion 110. Similar to FIG. 9, in FIG. 10, the area where the flexible wall 95 is disposed is depicted by a dot and dash line and illustration of the lid member 108 has been omitted.

In the first exemplary embodiment, the inner wall 98 is configured as an inclined wall 201 that includes an inclined surface 201*s* that opposes the liquid outlet portion 110. In the liquid flow out position, the inclined surface 201*s* is inclined downwards in a direction extending towards the third wall 103 from the fourth wall 104, in other words, the inclined surface 201*s* is inclined downwards in a direction extending towards the viewing portion 96 from the liquid outlet portion 110. Note that in order to avoid inhibiting the flow of the ink from the viewing portion 96 side towards the liquid outlet portion 110, a lower end portion of the inclined wall 201 is separated from the first wall 101 and the third wall 103. Furthermore, an upper end portion of the inclined wall 201 is separated from the second wall 102 and the fourth wall 104 so that air bubbles BB described later do not stagnate in an area below the inclined wall 201.

As described above, when the ink IK inside the liquid storing chamber 81 flows out through the liquid outlet portion 110, the atmospheric air is introduced into the liquid storing chamber 81 through the liquid outlet portion 110 in a concurrent manner. Accordingly, while the ink flows out through the liquid outlet portion 110, air bubbles BB created from the liquid outlet portion 110 move upwards in the liquid storing chamber 81. In the liquid container 80, such air bubbles BB are guided in a direction away from the viewing portion 96 by the inclined surface 201*s* of the inclined wall 201. Accordingly, the visual confirmation of the position of the liquid surface of the ink IK through the viewing portion 96 being inhibited, which is caused by the air bubbles BB attaching to the viewing portion 96 or the air bubbles BB making the liquid surface unclear, can be prevented.

As described above, when the volume of the liquid inside the liquid storing chamber 81 is expanded by changes in the outside air temperature and the outside air pressure, since the expansion of the volume of the liquid is absorbed by flexing and deformation of the flexible wall 95, the load applied to the housing member 90 is reduced in the liquid container 80 of the first exemplary embodiment.

Accordingly, durability to the changes in the outside air temperature and the outside air pressure is increased. Furthermore, in the liquid container 80 of the first exemplary embodiment, the flexible wall 95 is supported and the strength of the closing wall 94 is increased by having the inner wall 98, which is provided inside an area surrounded by the external circumferential wall 92, function as the reinforcing rib. Accordingly, even when external force is applied to the flexible wall 95 and the closing wall 94 by the user squeezing the liquid container 80, damage to the container body 82 is suppressed and the ink in the liquid storing chamber 81 can be suppressed from being spilt. Furthermore, in the liquid container 80 of the first exemplary embodiment, since the inner wall 98 is integrally formed together with the other walls 92 and 94 of the housing member 90, increase in the number of parts constituting the liquid container 80 caused by providing a separate inner wall 98 can be suppressed.

In the liquid container 80 of the first exemplary embodiment, the inner wall 98 functions as the inclined wall 201 that guides the air bubbles BB, which are created when the ink flows out through the liquid outlet portion 110, in a direction away from the viewing portion 96. Accordingly, when refilling the ink into the ink tanks 41 to 45, visibility of the position of the liquid surface of the liquid inside the liquid storing chamber 81 through the viewing portion 96 can be suppressed from decreasing.

Other than the above, in the liquid container 80 of the first exemplary embodiment, the container body 82 including a liquid storing chamber 81 therein is formed by joining the flexible wall 95 to the housing member 90 fabricated by injection molding. Compared with when an integral container body including therein the liquid storing chamber is fabricated by blow molding, the above configuration can reduce the manufacturing time and increase productivity. Accordingly, a reduction in the manufacturing cost can be achieved.

Furthermore, in the liquid container 80 of the first exemplary embodiment, since an opening portion for introducing atmospheric air does not have to be provided in the container body 82 separate to the liquid outlet portion 110, the configuration of the liquid container 80 can be simplified. In the liquid container 80 of the first exemplary embodiment, since the ink can be refilled into the ink tanks 41 to 45 without the user squeezing the container body 82, user usability is increased and the liquid container 80 can be suppressed from becoming damaged.

2. Second Exemplary Embodiment

Figure 11:
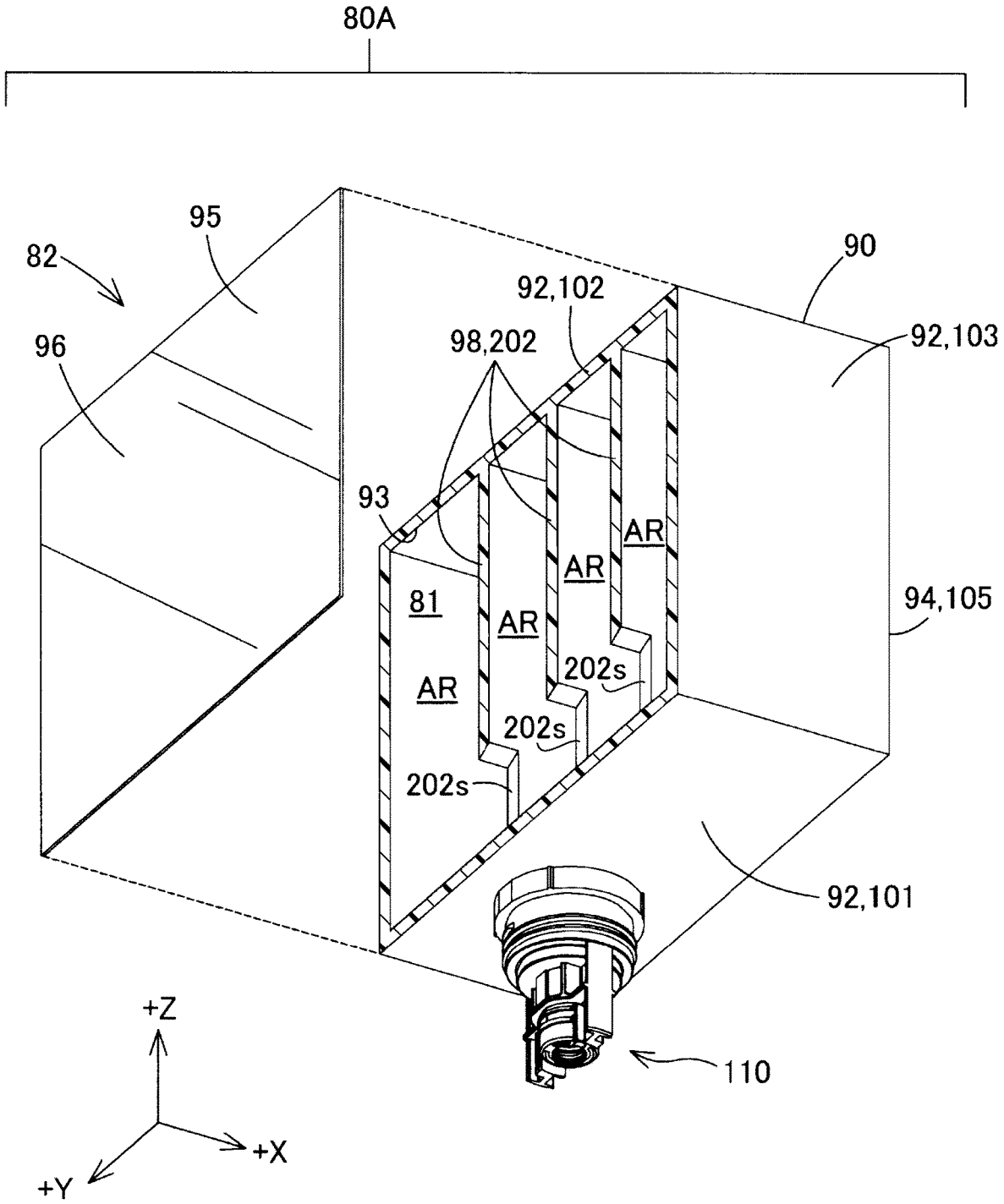
FIG. 11 is a schematic and exploded perspective view of a liquid container of a second exemplary embodiment.

FIG. 11 is a schematic and exploded perspective view illustrating a configuration of a liquid container 80A according to a second exemplary embodiment. FIG. 11 illustrates a state in which the flexible wall 95 has been removed from the housing member 90. The configuration of the liquid container 80A of the second exemplary embodiment is substantially the same as the configuration of the liquid container 80 of the first exemplary embodiment other than that the viewing portion 96 is provided, instead of the third wall 103, in the flexible wall 95, and that a configuration of the inner wall 98 is different.

In the liquid container 80A of the second exemplary embodiment, the flexible wall 95 is configured of a transparent film. Furthermore, the liquid container 80A does not include the lid member 108. In the liquid container 80A, the flexible wall 95 functions as the viewing portion 96, and the user can visually confirm the liquid surface of the ink inside the liquid storing chamber 81 through the flexible wall 95.

Note that rather than the transparent film, the flexible wall 95 may be configured of a translucent film. As described in the first exemplary embodiment, the flexible wall 95 may be covered by the lid member 108. In such a case, the lid member 108 may be fabricated of transparent or translucent resin so as to not hinder the visibility of the viewing portion 96 or may include a window through which the viewing portion 96 is exposed.

The inner wall 98 of the second exemplary embodiment includes a plurality of downwards extending walls 202 that, in the liquid flow out position, extend downwards from the second wall 102 of the external circumferential wall 92 and that are arranged in the horizontal direction. In the Y direction, the downwards extending walls 202 are provided between the liquid outlet portion 110 and the third wall 103. The liquid storing chamber 81 is partitioned into a plurality of areas AR arranged in the horizontal direction with the downwards extending walls 202. Slits 202*s* having a cut-out shape that communicate the areas AR divided by the downwards extending walls 202 to each other are provided at the lower ends of the downwards extending walls 202. Note that in the other exemplary embodiments, rather than a plurality of downwards extending walls 202, only a single downwards extending wall 202 may be provided. Furthermore, the downwards extending walls 202 may be provided between the liquid outlet portion 110 and the fourth wall 104.

Figure 12:
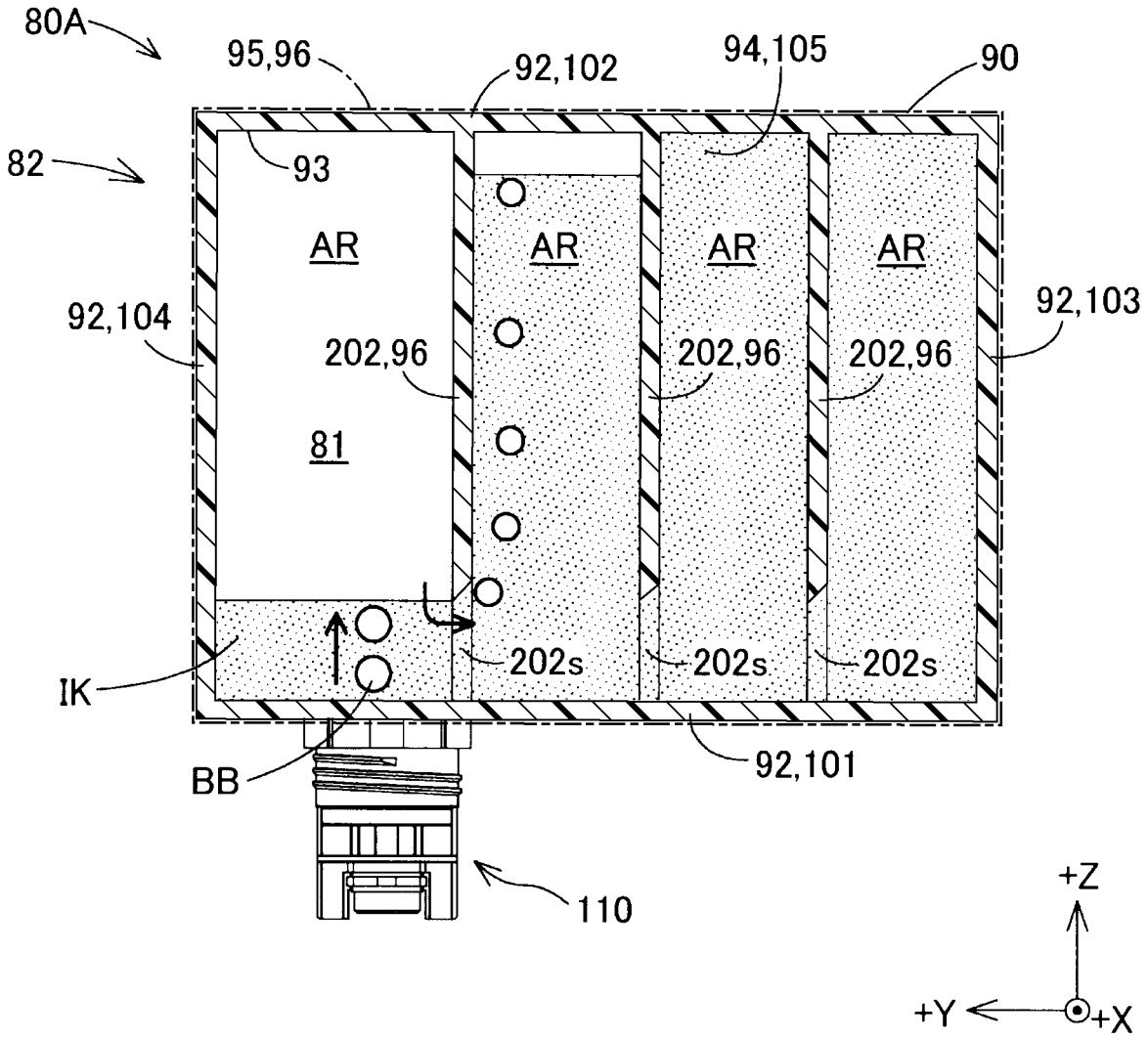
FIG. 12 is a schematic side view schematically illustrating a state inside the liquid container when ink flows out through the liquid outlet portion.

FIG. 12 is a schematic side view schematically illustrating a state inside the liquid container 80A when the ink IK in the liquid storing chamber 81 flows out through the liquid outlet portion 110. In FIG. 12, the liquid container 80A is illustrated in the fluid flow out position. Furthermore, in FIG. 12, for convenience sake, the area where the flexible wall 95 is disposed is depicted by a dot and dash line and illustration of the lid member 108 has been omitted.

As described above, in the liquid container 80A, the liquid storing chamber 81 is partitioned with the downwards extending walls 202 into the plurality of areas AR that are arranged from the liquid outlet portion 110 side towards the third wall 103 side and that are in communication with each other. When the ink IK in the liquid storing chamber 81 flows out through the liquid outlet portion 110 and when the atmospheric air is introduced into the liquid storing chamber 81 through the liquid outlet portion 110, the atmospheric air is stagnated in the areas AR in a sequential manner from the area AR closest to the liquid outlet portion 110 to the adjacent areas AR. With the above, since the ink IK decreases in a sequential manner from the area AR closest to the liquid outlet portion 110 to the areas AR on the third wall 103 side, it is easier for the user to grasp the remaining amount of ink IK inside the liquid storing chamber 81 through the viewing portion 96.

Note that as illustrated in FIG. 12, in the second exemplary embodiment, end surfaces of the slits 202*s* on the first wall 101 side are inclined so as to extend upwards from the liquid outlet portion 110 side towards the third wall 103 side. With the above, guiding of the atmospheric air to each of the areas AR is facilitated.

Figure 13:
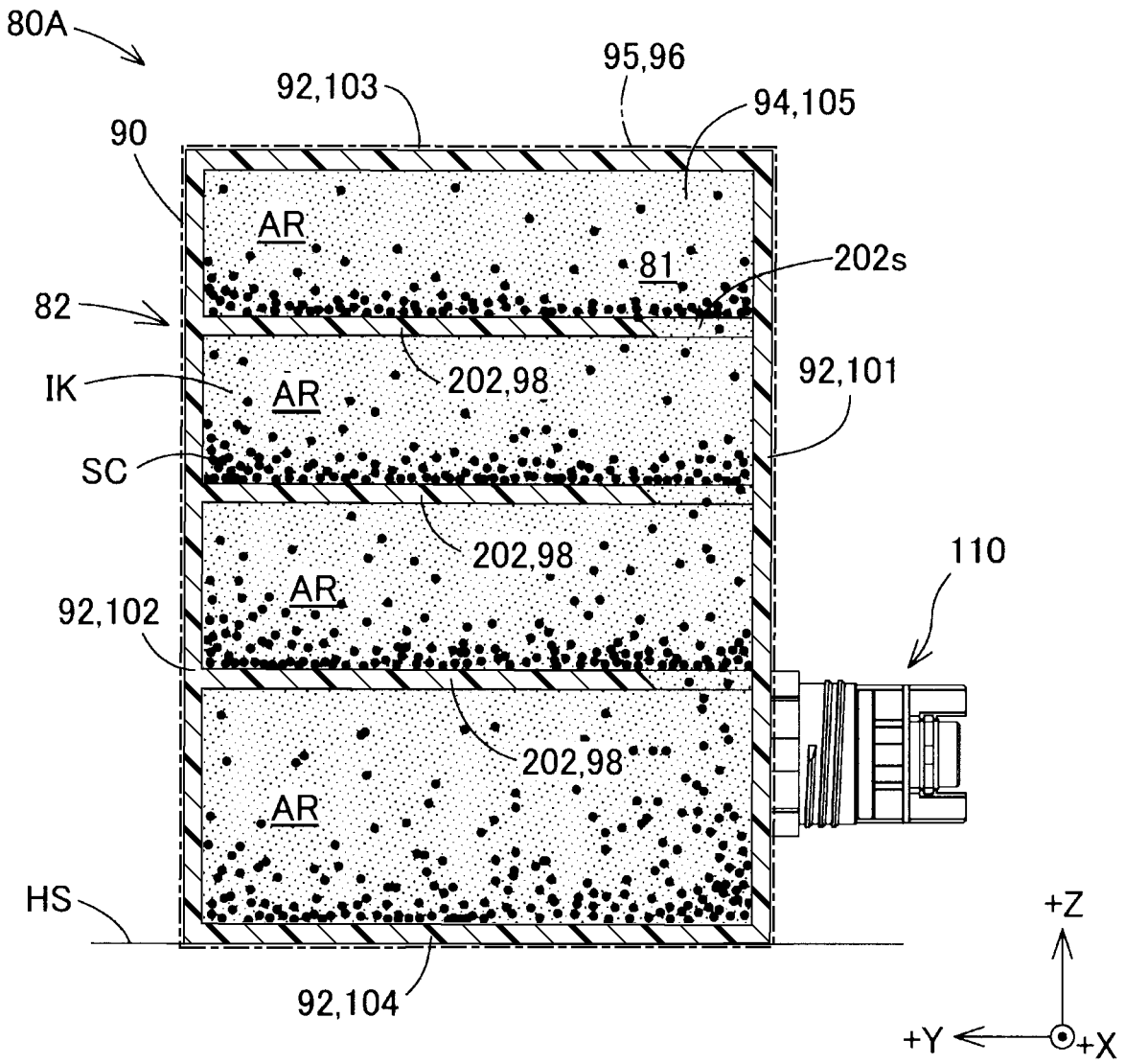
FIG. 13 is a schematic side view schematically illustrating a state in which the liquid container is disposed on a horizontal surface.

FIG. 13 is a schematic side view schematically illustrating a state in which the liquid container 80A having the ink IK containing a sedimenting component stored therein is disposed on a horizontal surface HS. Similar to FIG. 12, in the liquid container 80A in FIG. 13, the area where the flexible wall 95 is disposed is depicted by a dot and dash line and illustration of the lid member 108 has been omitted. Furthermore, FIG. 12 schematically illustrates sedimenting component SC contained in the ink IK. The sedimenting component SC is a pigment, for example.

The liquid container 80A is configured so as to be capable of being disposed in a position in which the fourth wall 104 serving as the bottom wall is disposed on the horizontal surface HS. In such a disposed position, each of the downwards extending walls 202 is disposed in the horizontal direction and, accordingly, will be referred to as a horizontal wall 202. When the liquid container 80A is left standing in a stable manner for a long period of time, for example, for a few hours to a few days in the above disposed position, the sedimenting component SC in the ink IK sediments on the lower sides of the areas AR partitioned by the horizontal walls 202. Accordingly, in such a case, the concentration gradient of the ink IK occurs so as to be dispersed in each of the areas AR, and bias in the concentration of the ink IK in the entire liquid storing chamber 81 in the Z direction can be suppressed. Accordingly, when the ink IK is refilled into one of the ink tanks 41 to 45 from the liquid container 80A, variation in the concentration of the refilled ink IK can be suppressed when compared with when no horizontal walls 202 are provided. Note that a similar effect can be obtained when the liquid container 80A is left standing in a stable manner for a long period of time in a disposed position in which the third wall 103 is, instead of the second wall 102, disposed as the bottom wall on the horizontal surface HS.

Other than the above, the liquid container 80A of the second exemplary embodiment can obtain advantageous effects similar to those described in the first exemplary embodiment above.

3. Third Exemplary Embodiment

Figure 14:
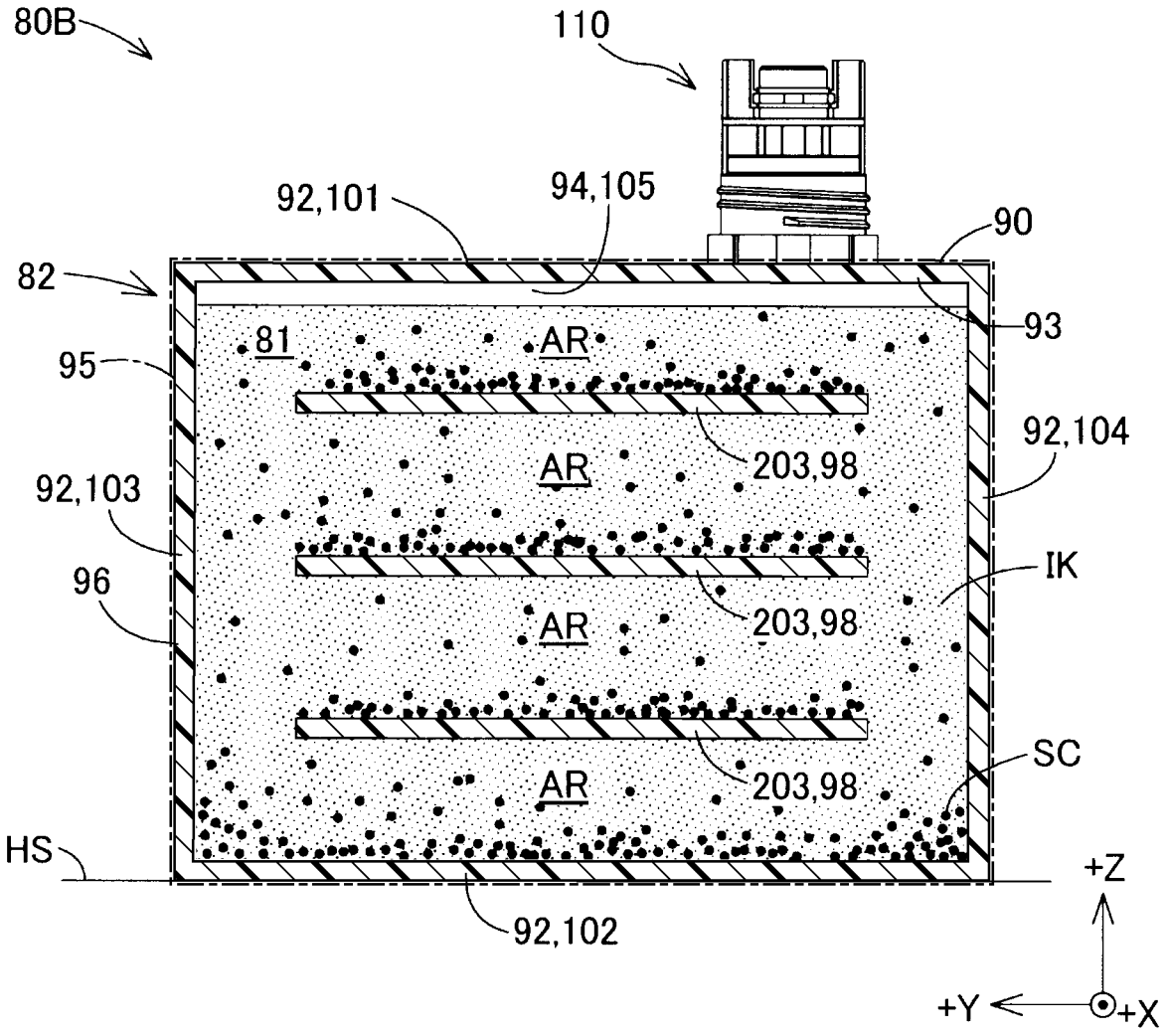
FIG. 14 is a schematic side view schematically illustrating a liquid container of a third exemplary embodiment.

FIG. 14 is a schematic side view schematically illustrating a liquid container 80B according to a third exemplary embodiment. In FIG. 14, for convenience sake, the area where the flexible wall 95 is disposed is depicted by a dot and dash line and illustration of the lid member 108 has been omitted. Furthermore, FIG. 14 illustrates as an example a state in which the liquid container 80B having the ink IK containing the sedimenting component SC is left standing in a stable manner on a horizontal surface HS for a long period of time.

The configuration of the liquid container 80B of the third exemplary embodiment is substantially the same as the configuration of the liquid container 80 of the first exemplary embodiment other than that the configuration of each inner wall 98 is different. Note that in the liquid container 80B, the viewing portion 96 may be omitted.

The liquid container 80B is configured so as to be capable of being disposed in a position in which the second wall 102 serving as the bottom wall is disposed on a horizontal surface. The inner walls 98 of the liquid container 80B constitute horizontal walls 203 that are each disposed in the horizontal direction when in the disposed position. In the third exemplary embodiment, a plurality of horizontal wall 203 are arranged vertically. FIG. 14 illustrates as an example a configuration in which three horizontal walls 203 are provided. Note that in other exemplary embodiments, only a single horizontal wall 203 may be provided.

One of the end portions of each horizontal wall 203 is provided at a position closer to the third wall 103 with respect to the center and the other end portion is provided at a position closer to the fourth wall 104 with respect to the center. In other exemplary embodiments, either one of the end portions of each horizontal wall 203 may be coupled to the third wall 103 or the fourth wall 104.

When the liquid container 80B is left standing in a stable manner for a long period of time, for example, for a few hours to a few days, in a disposed position in which the second wall 102 is the bottom wall, the sedimenting component SC in the ink IK sediments on the lower sides of the areas AR partitioned by the horizontal walls 203. Accordingly, in such a case, the concentration gradient of the ink IK is formed so as to be dispersed in each of the areas AR, and bias in the concentration of the ink IK in the entire liquid storing chamber 81 in the Z direction can be suppressed. Accordingly, when the ink IK is refilled into one of the ink tanks 41 to 45 from the liquid container 80B, variation in the concentration of the refilled ink IK can be suppressed when compared with when no horizontal walls 203 are provided. Note that a similar effect can be obtained even when the liquid container 80B is held with a support member in a position in which the first wall 101 is on the lower side and the second wall 102 is on the upper side, and is left standing in the above position for a long period of time.

Other than the above, the liquid container 80B of the third exemplary embodiment can obtain advantageous effects similar to those described in the first exemplary embodiment above.

4. Fourth Exemplary Embodiment

Figure 15:
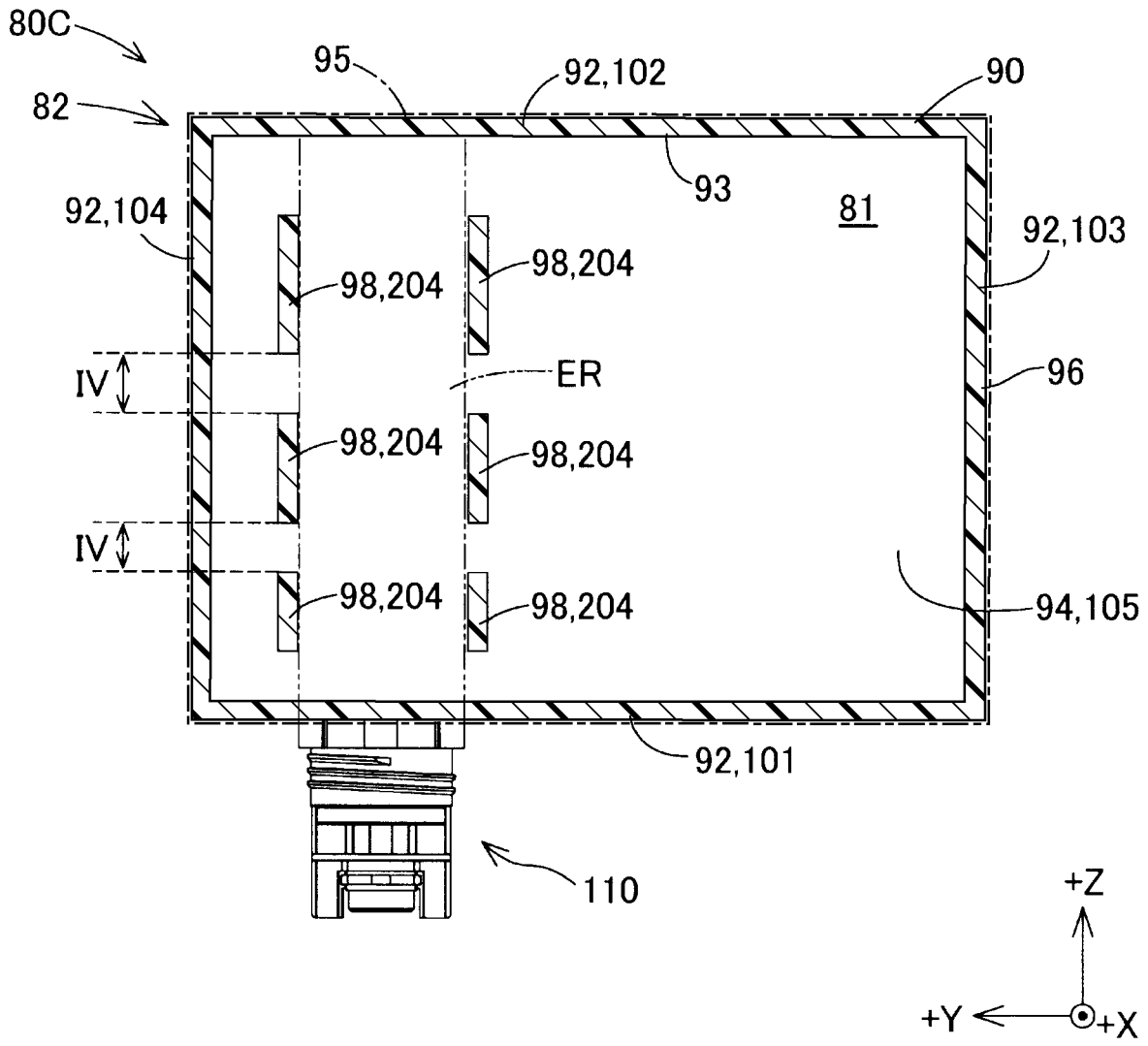
FIG. 15 is a schematic side view schematically illustrating a liquid container of a fourth exemplary embodiment.

FIG. 15 is a schematic side view schematically illustrating a liquid container 80C according to a fourth exemplary embodiment. FIG. 15 illustrates the liquid container 80C in the fluid flow out position. In FIG. 15, for convenience sake, the area where the flexible wall 95 is disposed is depicted by a dot and dash line and illustration of the lid member 108 has been omitted.

The configuration of the liquid container 80C of the fourth exemplary embodiment is substantially the same as the configuration of the liquid container 80 of the first exemplary embodiment other than that the configuration of each inner wall 98 is different. Note that in the liquid container 80C the viewing portion 96 may be omitted.

FIG. 15 illustrates an extended area ER in the liquid storing chamber 81 in which the area where the liquid outlet portion 110 is formed is extended in a direction opposite the gravitational direction. In the liquid container 80C, the inner walls 98 are configured as a plurality of guide walls 204 that are, at the lateral sides of the extended area ER, arranged along the extended area ER in a direction extending from the second wall 102 towards the first wall 101.

The guide walls 204 are arranged in the Z direction from positions closer to the second wall 102 to positions closer to the first wall 101. The guide walls 204 are provided at positions adjacent to each other in each of the end portions of the extended area ER in the Y direction. Intervals IV between the guide walls 204 in the Z direction become smaller as the intervals IV become positioned closer to the liquid outlet portion 110. The reason for the above will be described later. Note that in other exemplary embodiments, the intervals at which the guide walls 204 are arranged in the Z direction may be uniform or may be determined regardless of the position relative to the liquid outlet portion 110.

Figure 16:
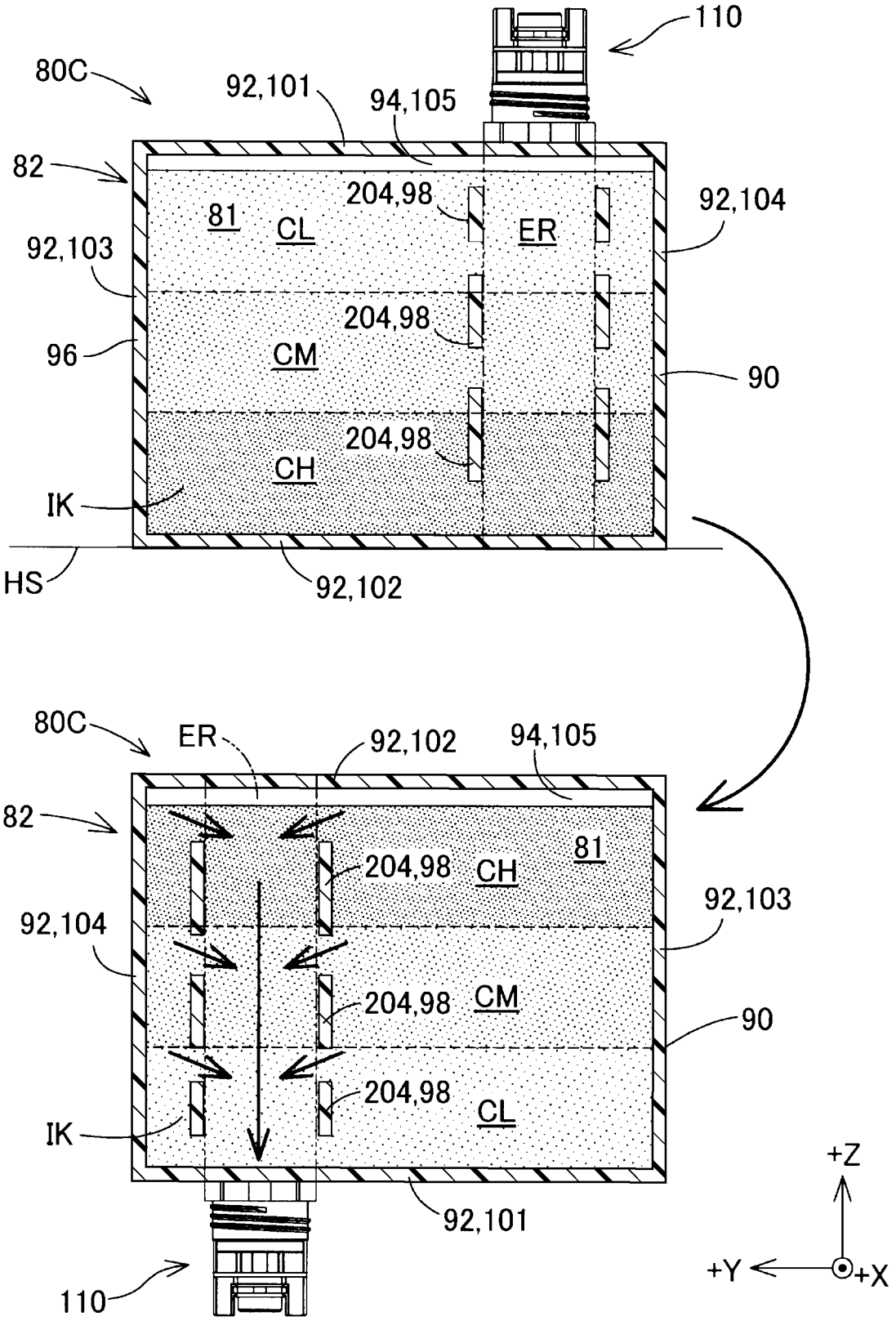
FIG. 16 is a schematic diagram illustrating a state in which the liquid container is set to a fluid flow out position after being left standing in a stable manner.

FIG. 16 is a schematic diagram illustrating a function of the guide walls 204. FIG. 16 schematically illustrates a state when the liquid container 80C that has been left standing for a long period of time in the disposed position in which the second wall 102 is the bottom wall is moved to the fluid flow out position. Note that for convenience sake, illustration of the lid member 108 and the flexible wall 95 is omitted in FIG. 16.

Note that FIG. 16 illustrates that there is a concentration gradient in the ink IK stored in the liquid storing chamber 81 due to the sedimenting component by hatching the ink IK with halftone dots at different concentrations. While in FIG. 16, for convenience sake, the liquid storing chamber 81 is divided into three areas, namely, a high concentration area CH, an intermediate concentration area CM, and a low concentration area CL in which the concentrations of the ink IK are different, in actuality, the liquid storing chamber 81 is not clearly separated into areas of different concentrations as above. FIG. 16 only illustrates a general tendency.

When the ink IK contains a sedimenting component and when the liquid container 80C is left standing in a stable manner for a long period of time, for example, for a few hours to a few days, in a disposed position in which the second wall 102 is the bottom wall, as illustrated in FIG. 16, a concentration gradient occurs, in which the concentration becomes higher towards the lower side, in the ink IK inside the liquid storing chamber 81. Accordingly, as illustrated in the lower portion of FIG. 16, when the liquid container 80C is turned to the fluid flow out position from the disposed position, the concentration of the ink IK becomes higher at positions away from the liquid outlet portion 110 and the concentration of the ink IK becomes lower at positions closer to the liquid outlet portion 110.

If the guide walls 204 are not provided inside the liquid storing chamber 81, the ink IK in the low concentration area CL close to the liquid outlet portion 110 will first flow out through the liquid outlet portion 110. On the other hand, in the liquid container 80C, due to a flow path resistance inside the liquid storing chamber 81 caused by providing the guide walls 204, the ink IK in the area including the extended area ER interposed between the guide walls 204 flows out through the liquid outlet portion 110 more easily than the ink IK outside the area including the extended area ER interposed between the guide walls 204. Accordingly, the ink IK that is outside the area interposed by the guide walls 204 and that is in the areas CH, CM, and CL having different concentrations can be made to flow out to the outside through the liquid outlet portion 110 after flowing into the extended area ER through the gaps between the guide walls 204 and being mixed inside the extended area ER. Accordingly, when the ink IK is refilled into one of the ink tanks 41 to 45 from the liquid container 80C, variation in the concentration of the refilled ink IK can be suppressed.

In the fourth exemplary embodiment, as described above, the intervals IV between the guide walls 204 in the Z direction become smaller as the intervals IV become closer to the liquid outlet portion 110 so that the flow path resistance in the gaps between the guide walls 204 become smaller towards the upper side when in the liquid flow out position. Accordingly, the ink IK that is positioned on the upper side when in the liquid flow out position and that has higher concentration flows into the extended area ER more easily. Accordingly, the variation in the concentration of the ink IK flowing out through the liquid outlet portion 110 can be reduced furthermore.

As described above, the guide walls 204 are provided on both sides of the extended area ER in the fourth exemplary embodiment. However, in other exemplary embodiments, the guide walls 204 may be provided on only one side of the extended area ER. In such a case as well, the ink IK on the extended area ER side with respect to the guide wall 204 flows out through the liquid outlet portion 110 more easily than the ink IK on the side opposite the extended area ER with respect to the guide walls 204. Accordingly, the ink IK on the side opposite the extended area ER with respect to the guide walls 204 and that is in the areas CH, CM, and CL having different concentrations can be made to flow inside the extended area ER through the gaps between the guide walls 204 and be mixed inside the extended area ER. Accordingly, when the ink IK is refilled into one of the ink tanks 41 to 45 from the liquid container 80C, variation in the concentration of the refilled ink IK can be suppressed. Note that when the guide walls 204 are provided on both sides of the extended area ER, the ink IK outside the extended area ER on both sides of the extended area ER and that is in the areas CH, CM, and CL having different concentrations can be mixed inside the extended area ER. Accordingly, compared with when the guide walls 204 are provided only on one side of the extended area ER, the variation in the concentration of the ink IK refilled into the ink tanks 41 to 45 can be suppressed furthermore.

Other than the above, the liquid container 80C of the fourth exemplary embodiment can obtain advantageous effects similar to those described in the first exemplary embodiment above.

5. Fifth Exemplary Embodiment

Figure 17:
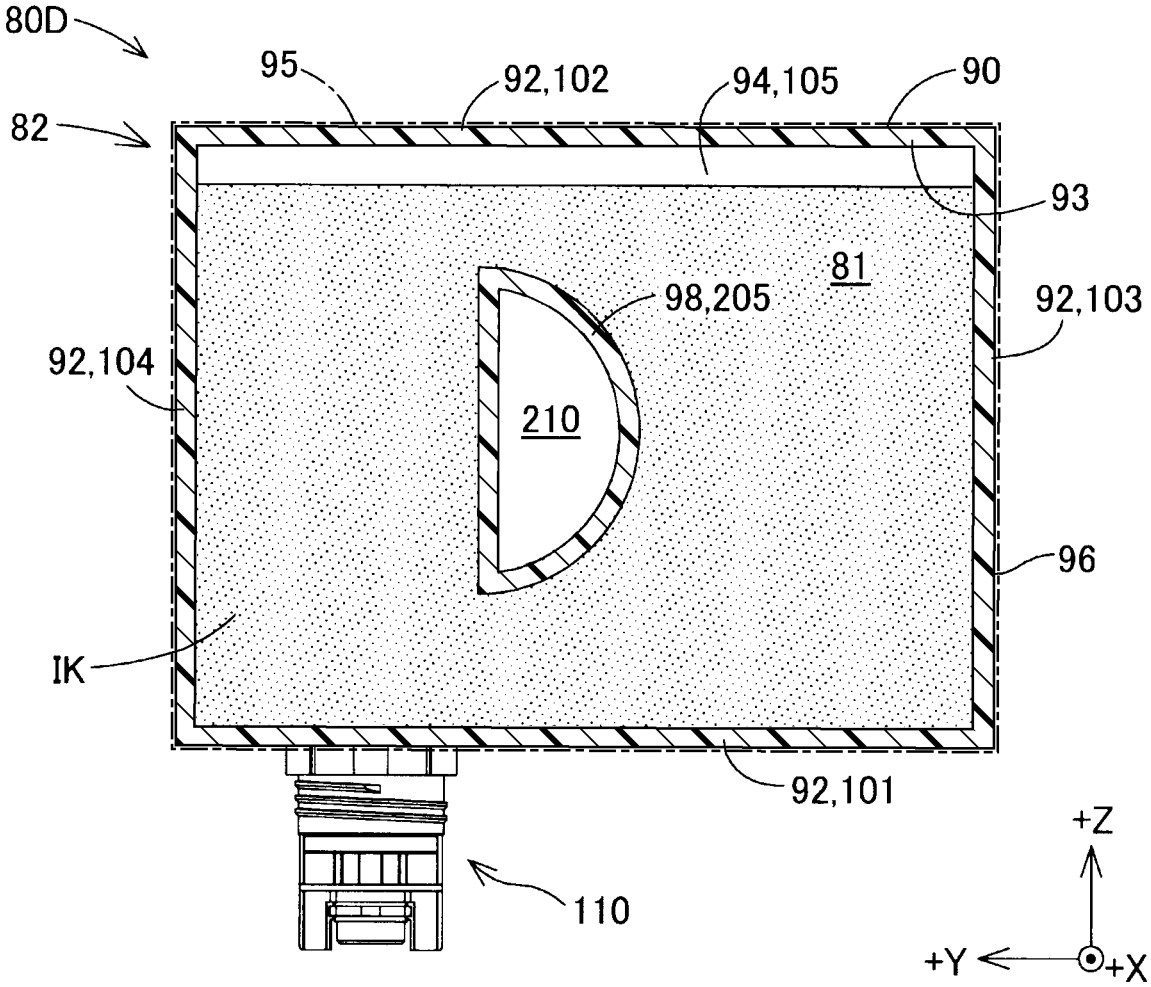
FIG. 17 is a schematic side view schematically illustrating a liquid container of a fifth exemplary embodiment.

FIG. 17 is a schematic side view illustrating a configuration of a liquid container 80D according to a fifth exemplary embodiment. FIG. 17 illustrates the liquid container 80D having the ink IK stored in the liquid storing chamber 81 in the fluid flow out position. Furthermore, in FIG. 17, for convenience sake, the area where the flexible wall 95 is disposed is depicted by a dot and dash line and illustration of the lid member 108 has been omitted.

The configuration of the liquid container 80D of the fifth exemplary embodiment is substantially the same as the configuration of the liquid container 80 of the first exemplary embodiment other than that a through hole 210 is formed in the closing wall 94 and that the configuration of the inner wall 98 is different. Note that in the liquid container 80D, the viewing portion 96 may be omitted.

In the liquid container 80D, the through hole 210 that penetrates the closing wall 94 in the X direction is formed. In the liquid container 80D, the inner wall 98 is configured as an inner circumferential wall 205 that, inside the area surrounded by the external circumferential wall 92, constitutes a lateral wall of the through hole 210. An end surface of the inner circumferential wall 205 on the flexible wall 95 side is, throughout the entire circumference thereof, welded to the flexible wall 95 so that the opening portion 93 of the housing member 90 is sealed in a watertight manner. "Watertight" may be rephrased as "liquid tight". Note that in the fifth exemplary embodiment, while not illustrated in the drawings, a through hole that is in communication with an area surrounded by the inner circumferential wall 205 is formed in the flexible wall 95 and the lid member 108. However, in other exemplary embodiments, such a through hole do not have to be formed in the flexible wall 95 and the lid member 108.

The through hole 210 is provided at the middle of the liquid storing chamber 81 and with a size allowing the fingertip of the user to be inserted therein. The user can carry the liquid container 80D by inserting a finger inside the through hole 210 from the closing wall 94 side. In other words, in the liquid container 80D, a holding portion that the user holds is formed with the through hole 210 and the inner circumferential wall 205 that defines the through hole 210. By forming the holding portion, handling of the liquid container 80D is facilitated for the user.

Furthermore, by having the user use the holding portion, other portions of the closing wall 94 and the flexible wall 95 can be prevented from being held and pressed by the fingers of the user. Accordingly, application of external force to the flexible wall 95 and the ink IK spilling from the liquid storing chamber 81 can be prevented. Furthermore, similar to the inner wall 98 described in the other exemplary embodiments above, in the liquid container 80D, since the inner circumferential wall 205 functions as a reinforcing rib that supports the flexible wall 95, the durability of the flexible wall 95 is increased.

Figure 18:
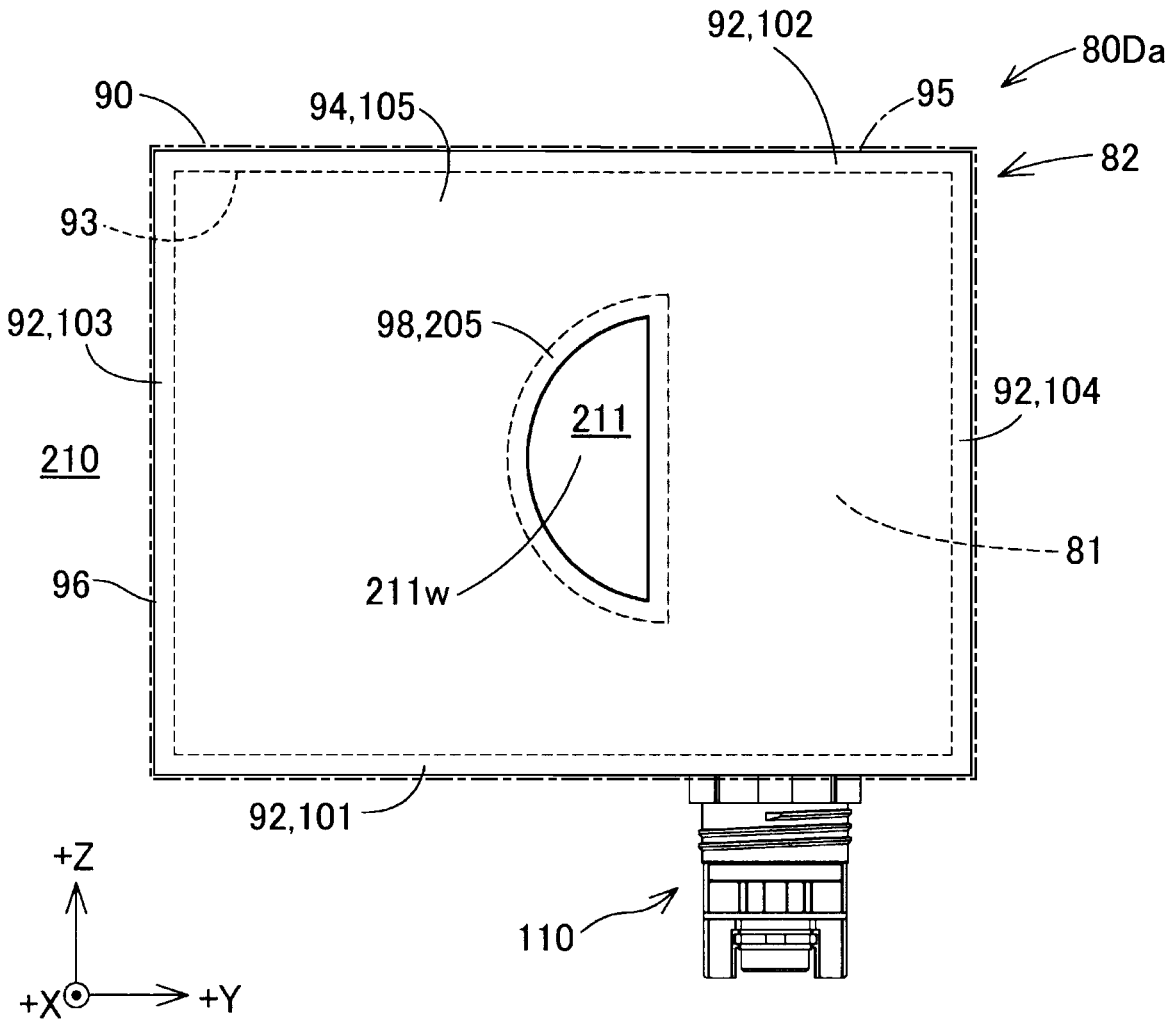
FIG. 18 is a schematic side view illustrating another example configuration of the liquid container of the fifth exemplary embodiment.

FIG. 18 is a schematic side view illustrating a liquid container 80Da serving as another example configuration of the fifth exemplary embodiment. FIG. 18 illustrates a closing wall 94 side of the liquid container 80Da in the fluid flow out position. Furthermore, in FIG. 18, the area where the flexible wall 95 is disposed is depicted by a dot and dash line and illustration of the lid member 108 has been omitted.

In place of the through hole 210, a bottomed recessed portion 211 that is depressed towards the liquid storing chamber 81 side and that constitutes a holding portion is provided in the closing wall 94 of the liquid container 80Da. In such a case, the inner circumferential wall 205 is configured to constitute a lateral wall of the recessed portion 211 and to be in contact with the flexible wall 95. Note that the inner circumferential wall 205 and a bottom wall 211*w* of the recessed portion 211 do not have to be welded to the flexible wall 95. The liquid container 80Da illustrated in FIG. 18 can obtain an advantageous effect similar to that of the liquid container 80D illustrated in FIG. 17.

Note that while in FIGS. 17 and 18, examples in which the closing wall 94 includes the through hole 210 or the recessed portion 211 having a semicircular opening shape are illustrated, the shapes of the openings of the through hole 210 and the recessed portion 211 are not limited to any particular shapes. The through hole 210 and the recessed portion 211 may, for example, be a circular opening shape or a rectangular opening shape. Furthermore, the positions where the through hole 210 and the recessed portion 211 are formed are not limited to the middle of the liquid storing chamber 81 and, for example, may be formed in a position close to the external circumferential wall 92.

Other than the above, the liquid containers 80D and 80Da of the fifth exemplary embodiment can obtain advantageous effects similar to those described in the first exemplary embodiment above.

6. Other Exemplary Embodiments

The various configurations described in the exemplary embodiments described above can be changed in the following manner, for example. Other exemplary embodiments described below are, in a similar manner to the exemplary embodiments described above, regarded as examples of configurations that embody the technique of the present disclosure.

First Another Exemplary Embodiment

The configurations of the walls 201 to 205 described in the exemplary embodiments above can be combined as appropriate. In other words, the inner wall 98 may include a wall that is an appropriate combination of any two or more configurations of the walls 201 to 205 described in the exemplary embodiments above. For example, as the inner wall 98, the inclined wall 201 of the first exemplary embodiment and the downwards extending wall 202 of the second exemplary embodiment may be included in the area surrounded by the external circumferential wall 92 or the downwards extending wall 202 of the second exemplary embodiment and the horizontal wall 203 of the third exemplary embodiment may be included. In such a case, the walls 201 to 205 may be coupled to each other while intersecting each other. Accordingly, as the inner wall 98, a wall in which the downwards extending wall 202 and the horizontal wall 203 are intersected crosswise may be provided in the liquid storing chamber 81, for example.

Second Another Exemplary Embodiment

The shape of the external circumferential wall 92 included in the housing member 90 is not limited to a square tubular shape formed by the four walls 101 to 104 constituting the four lateral surfaces. The external circumferential wall may have another shape and, for example, may have a triangular tubular shape, a pentagonal tubular shape, or a polygonal tubular shape having more corners. Furthermore, the external circumferential wall 92 may have a cylindrical shape or an elliptic tubular shape. The external circumferential wall 92 may not include a wall functioning as the bottom wall configured to be disposed on a horizontal surface in a horizontal direction or may include only one wall.

Third Another Exemplary Embodiment

In the exemplary embodiments described above, the inner wall 98 may be welded to the flexible wall 95. Even with such a configuration, as long as the flexible wall 95 is provided, the expansion of the content of the liquid storing chamber 81 can be absorbed by flexing and deformation of the flexible wall 95.

Fourth Another Exemplary Embodiment

In the exemplary embodiments described above, the liquid outlet portion 110 may be, rather than being attached to the housing member 90 later, fabricated in an integral manner together with the housing member 90.

7. Example Configurations

The technique of the present disclosure is not limited to the exemplary embodiments and the examples described above and may be implemented through various configurations that do not depart from the scope of the disclosure. For example, the technique of the present disclosure can be implemented through the following configurations. The technical features of the exemplary embodiments described above that correspond to the technical features of the configurations described below may be appropriately replaced or combined in order to overcome a portion or all of the issues that the technique of the present disclosure is to overcome, or in order to achieve a portion or all of the effects that the technique of the present disclosure is to provide. Furthermore, the technical features that are not described in the present specification as an essential feature may be omitted as appropriate.

1. A first configuration is provided as a liquid container. The liquid container of such a configuration includes a liquid storing chamber in which a liquid is stored, and a liquid outlet portion coupled to the liquid storing chamber, in which the liquid in the liquid storing chamber is made to flow out through the liquid outlet portion when in a liquid flow out position in which the liquid outlet portion is positioned below the liquid storing chamber. Furthermore, the liquid container of such a configuration includes a valve provided in the liquid outlet portion, the valve being opened by having both a first pipe through which atmospheric air flows and a second pipe through which the liquid flows inserted therein when the liquid is made to flow out from the liquid storing chamber; a housing member in which the liquid storing chamber is defined therein, the housing member including an external circumferential wall that surrounds the liquid storing chamber, an opening portion surrounded by an end portion of the external circumferential wall, and a closing wall that opposes the liquid storing chamber at a position deep inside with respect to the opening portion, an external edge portion of the closing wall being coupled to an end portion of the external circumferential wall, wherein the liquid outlet portion is provided in the external circumferential wall; a flexible wall having flexibility, the flexible wall sealing the opening portion; and an inner wall that extends from the closing wall towards an opening portion side in an area surrounded by the external circumferential wall and that is in contact with the flexible wall.

According to the liquid container of such a configuration, even when the content in the liquid storing chamber becomes expanded due to changes in the outside air temperature and the outside air pressure, the expanded volume can be absorbed by flexing and deforming of the flexible wall. Accordingly, since the load that the housing member receives due to such an expansion of the content is reduced, the durability of the liquid container is increased. Furthermore, since the inner wall provided in the area surrounded by the external circumferential wall functions as a reinforcing rib that reinforces the closing wall and the flexible wall, durability to external force that compresses the liquid storing chamber can be increased. Accordingly, when the liquid storing chamber is squeezed, the liquid container can be prevented from becoming damaged and the liquid inside the liquid storing chamber can be prevented from being spilt. Furthermore, according to the liquid container of such a configuration, since the inner wall and the housing member can be fabricated integrally, an increase in the number of parts of the liquid container by providing the inner wall can be suppressed.

2. The liquid container of the above configuration may be provided with a viewing portion configured to allow a position of a liquid surface in the liquid storing chamber to be visually confirmed from a lateral side of the liquid storing chamber when in the liquid flow out position.

According to the liquid container of such a configuration, since the user can confirm the existence of the liquid from the outside of the liquid container, user-friendliness can be increased.

3. In the liquid container of the above configuration, in the liquid flow out position, the external circumferential wall may include a pair of sidewalls that interpose the liquid storing chamber in between while opposing each other in a horizontal direction, the viewing portion may be provided in one of the pair of sidewalls, and in the liquid flow out position, the inner wall may include an inclined wall having an inclined surface that opposes the liquid outlet portion and that inclines downwardly in a direction extending from the liquid outlet portion towards the viewing portion.

According to the liquid container of such a configuration, when the liquid flows out through the liquid outlet portion, the air bubbles in the liquid storing chamber created from the liquid outlet portion are guided by the inclined surface of the inclined wall in a direction away from the viewing portion. Accordingly, the visibility of the position of the liquid surface in the viewing portion can be prevented from being inhibited by the air bubbles.

4. In the liquid container of the above configuration, the viewing portion may be provided in the flexible wall, the inner wall may include, in the liquid flow out position, a downwards extending wall that extends downwards from the external circumferential wall and that partitions the liquid storing chamber into a plurality of areas arranged in a horizontal direction, and a slit that communicates the plurality of areas to each other may be provided in a lower end of the downwards extending wall.

According to the liquid container of such a configuration, when the liquid flows out through the liquid outlet portion, the atmospheric air introduced into the liquid storing chamber through the liquid outlet portion is accumulated in a sequential manner from the area closest to the liquid outlet portion, among the plurality of areas divided by the downwards extending walls, to the adjacent areas. Accordingly, since the liquid decreases in a sequential manner in the plurality of areas arranged in the horizontal direction, it is easier for the user to grasp the amount of liquid remaining in the liquid storing chamber through the viewing portion.

5. In the liquid container of the above configuration, the external circumferential wall may include a plate-shaped bottom wall, and the liquid container may be configured to be disposed in a disposed position in which the liquid outlet portion is positioned above the bottom wall and in which the bottom wall is disposed along a horizontal surface.

According to the liquid container of such a configuration, the liquid container that is not used can be left standing easily.

6. The liquid container of the above configuration may be provided with a viewing portion configured to allow a position of a liquid surface in the liquid storing chamber to be visually confirmed from a lateral side of the liquid storing chamber when in the liquid flow out position.

According to the liquid container of such a configuration, since the user can confirm the existence of the liquid from the outside of the liquid container, user-friendliness can be increased.

7. In the liquid container of the above configuration, in the disposed position, the inner wall may include a horizontal wall disposed in a horizontal direction.

According to the liquid container of such a configuration, when in the disposed position, the liquid storing chamber is partitioned into a plurality of areas with the horizontal walls. With the above, when the liquid container stores a liquid containing a sedimenting component and when left standing in a stable manner in the disposed position for a long period of time, the concentration gradient occurs in a dispersed manner in the areas partitioned by the horizontal walls. Accordingly, compared to not being partitioned by the horizontal walls, bias in the concentration in the liquid storing chamber while in the disposed position can be reduced and variation in the concentration of the liquid when the liquid flows out through the liquid outlet portion can be suppressed.

8. In the liquid container of the above configuration, when in the liquid flow out position, the inner wall includes a plurality of guide walls arranged at a lateral side of an extended area, the extended area being an area where the liquid outlet portion is formed is extended upwards, and along the extended area.

According to the liquid container of such a configuration, even when a concentration gradient occurs in the liquid that is stored in the liquid storing chamber and that contains the sedimenting component while being left standing in the disposed position, the liquid in each area having different concentrations can be mixed and guided to the liquid outlet portion with the guide walls.

Accordingly, the variation in the concentration of the liquid flowing out through the liquid outlet portion can be suppressed.

9. In the liquid container of the above configuration, the closing wall may include a through hole or a recessed portion depressed towards a liquid storing chamber side, and in an area surrounded by the external circumferential wall, the inner wall may include an inner circumferential wall that constitutes a lateral wall of the through hole or the recessed portion.

According to the liquid container of such a configuration, the through hole or the recessed portion having the inner circumferential wall as the lateral wall can function as a holding portion to which the finger of the user can be hooked when holding the liquid container.

8. Others

The technique of the present disclosure can be implemented in various configurations other than the liquid container. The technique of the present disclosure can be implemented in configurations such as, for example, a method of manufacturing a liquid container, a structure of a liquid container, a liquid consuming system, a liquid refilling system, and a method of refilling a liquid into a liquid consuming device.

Furthermore, the configuration of the liquid container of the present disclosure can be applied to liquid containers that are used in any liquid ejecting apparatuses that consume a liquid other than ink. For example, the configuration of the liquid container of the present disclosure can be applied to liquid containers that are used in various liquid ejecting apparatuses described below:

an image recording device such as a facsimile machine, a coloring material ejection device used to manufacture a color filter of an image display device such as a liquid crystal display, an electrode material ejection device used to form electrodes of organic electroluminescence (EL) displays and surface emitting displays (field emission display or FED), a liquid ejection device that ejects a liquid containing bio-organic matter to manufacture biochips, a sample ejection device serving as a precision pipette, lubricating oil injection device, resin liquid ejecting apparatus, a liquid ejection device that ejects lubricant oil in a pinpoint manner to precision instruments such as a watch and a camera, a liquid ejection device that sprays transparent liquid resin such as ultraviolet curing resin on a substrate in order to form a hemispherical microlens (optical lens) used in optical communication elements and the like, a liquid ejection device that ejects acid or alkaline etching solution for etching substrates and the like, and a liquid ejection device including a liquid consuming head that ejects any micro amount of droplets other than the above.

The liquid contained in the liquid container of the present disclosure may be any material in liquid phase. Accordingly, the "liquid" in the present disclosure includes a material in a liquid state with high or low viscosity, and materials in a liquid state such as sol, gel water, other inorganic solvents, an organic solvent, a solution, liquid resin, and liquid metal (metallic melt). Furthermore, not just liquid as a state of matter, the liquid includes particles of functional material including a solid body such as a pigment or metal particle that is dissolved, dispersed, or mixed in a solvent. Other than the above, a representative example of the liquid includes ink, liquid crystal, and others that have been described in the exemplary embodiments described above. Note that "ink" includes various liquid-form compositions such as a typical aqueous ink, solvent ink, gel ink, and a hot melt ink.

What is claimed is:

1. A liquid container including a liquid storing chamber in which a liquid is stored, and a liquid outlet portion coupled to the liquid storing chamber, in which the liquid in the liquid storing chamber is made to flow out through the liquid outlet portion when in a liquid flow out position in which the liquid outlet portion is positioned below the liquid storing chamber, the liquid container comprising:

a valve provided in the liquid outlet portion, the valve being opened by having both a first pipe through which atmospheric air flows and a second pipe through which the liquid flows inserted therein when the liquid is made to flow out from the liquid storing chamber;

a housing member in which the liquid storing chamber is defined therein, the housing member including an external circumferential wall that surrounds the liquid storing chamber, an opening portion surrounded by an end portion of the external circumferential wall, and a closing wall that opposes the liquid storing chamber at a position deep inside with respect to the opening portion, an external edge portion of the closing wall being coupled to an end portion of the external circumferential wall, wherein the liquid outlet portion is provided in the external circumferential wall;

a flexible wall having flexibility, the flexible wall sealing the opening portion;

an inner wall that extends from the closing wall towards an opening portion side in an area surrounded by the external circumferential wall and that is in contact with the flexible wall; and a viewing portion configured to allow a position of a liquid surface in the liquid storing chamber to be visually confirmed from a lateral side of the liquid storing chamber when in the liquid flow out position, wherein the viewing portion is provided in the flexible wall, in the liquid flow out position, the inner wall includes a downwards extending wall that extends downwards from the external circumferential wall and that partitions the liquid storing chamber into a plurality of areas arranged in a horizontal direction, and a slit that communicates the plurality of areas to each other is provided in a lower end of the downwards extending wall.

2. The liquid container according to claim 1, wherein in the liquid flow out position, the external circumferential wall includes a pair of sidewalls that interpose the liquid storing chamber in between while opposing each other in a horizontal direction, the viewing portion is provided in one of the pair of sidewalls, and in the liquid flow out position, the inner wall includes an inclined wall having an inclined surface that opposes the liquid outlet portion and that inclines downwardly in a direction extending from the liquid outlet portion towards the viewing portion.

3. The liquid container according to claim 1, wherein the external circumferential wall includes a plate-shaped bottom wall, and the liquid container is configured to be disposed in a disposed position in which the liquid outlet portion is positioned above the bottom wall and in which the bottom wall is disposed along a horizontal surface.

4. The liquid container according to claim 3, further comprising:

a viewing portion configured to allow a position of a liquid surface in the liquid storing chamber to be visually confirmed from a lateral side of the liquid storing chamber when in the liquid flow out position.

5. The liquid container according to claim 3, wherein in the disposed position, the inner wall includes a horizontal wall disposed in a horizontal direction.

6. The liquid container according to claim 3, wherein in the liquid flow out position, the inner wall includes a plurality of guide walls arranged at a lateral side of an extended area, the extended area being an area where the liquid outlet portion is formed is extended upwards, and along the extended area.

7. The liquid container according to claim 1, wherein the closing wall includes a through hole or a recessed portion depressed towards a liquid storing chamber side, and in an area surrounded by the external circumferential wall, the inner wall includes an inner circumferential wall that constitutes a lateral wall of the through hole or the recessed portion.

* * * * *